US008926385B1

(12) United States Patent
Woods et al.

(10) Patent No.: US 8,926,385 B1
(45) Date of Patent: Jan. 6, 2015

(54) HIGH EFFICIENCY SWIM FIN USING MULTIPLE HIGH ASPECT RATIO HYDRODYNAMIC VANES WITH PLIABLE HINGES AND ROTATION LIMITERS

(71) Applicants: David Woods, Belle Isle, FL (US); Ron Evan Smith, Sahuarita, AZ (US)

(72) Inventors: David Woods, Belle Isle, FL (US); Ron Evan Smith, Sahuarita, AZ (US)

(73) Assignee: David Woods, Belle Isle, FL (US)

( * ) Notice: Subject to any disclaimer, the term of this patent is extended or adjusted under 35 U.S.C. 154(b) by 112 days.

(21) Appl. No.: 13/871,161

(22) Filed: Apr. 26, 2013

Related U.S. Application Data

(63) Continuation-in-part of application No. 12/939,393, filed on Nov. 4, 2010, now Pat. No. 8,480,446.

(60) Provisional application No. 61/646,679, filed on May 14, 2012, provisional application No. 61/280,375, filed on Nov. 2, 2009.

(51) Int. Cl.
*A63B 31/08* (2006.01)
*A63B 31/11* (2006.01)

(52) U.S. Cl.
CPC ..... *A63B 31/11* (2013.01)
USPC ..... 441/64

(58) Field of Classification Search
USPC ..... 441/55, 60, 61, 62, 63, 64
See application file for complete search history.

(56) References Cited

U.S. PATENT DOCUMENTS

| | | | |
|---|---|---|---|
| 107,376 | A | 9/1870 | Hunter |
| 2,709,052 | A | 5/1955 | Berg |
| 2,729,832 | A | 1/1956 | Schmitz |
| 2,987,332 | A | 6/1961 | Bonmartini |
| 3,084,355 | A | 4/1963 | Ciccotelli |
| 3,122,759 | A | 3/1964 | Gongwer |
| 3,411,165 | A | 11/1968 | Murdoch |
| 4,097,958 | A | 7/1978 | Van Dell |
| 4,146,199 | A | 3/1979 | Wenzel |
| 4,178,128 | A | 12/1979 | Gongwer |
| 4,209,866 | A | 7/1980 | Loeffler |
| 4,705,240 | A | 11/1987 | Dixon |
| 4,738,645 | A | 4/1988 | Garofalo |
| 4,767,083 | A | 8/1988 | Koenig |
| 4,767,368 | A | 8/1988 | Ciccotelli |
| 4,781,637 | A | 11/1988 | Caires |
| 4,944,703 | A | 7/1990 | Mosier |
| 4,949,919 | A | 8/1990 | Wajnikonis |
| 4,981,454 | A | 1/1991 | Klein |
| 5,330,377 | A | 7/1994 | Kernek |
| 5,536,190 | A | 7/1996 | Althen |

(Continued)

*Primary Examiner* — Daniel V Venne
(74) *Attorney, Agent, or Firm* — Brian S. Steinberger; Law Offices of Brian S. Steinberger, P.A.

(57) ABSTRACT

Apparatus, devices and methods of multiple high aspect ratio hydrodynamic horizontal ladder oriented vanes with pliable hinges and rotation limiting flexible webs attached between semi-flexible support beams on swim fins. Pivotal rotation of the hydrofoil vanes can be restricted by flexible membranes, between the hydrofoil vanes and the support beams, to provide an optimum angle of attack for the hydrofoil vanes during a swimming stroke. The fins can have at least one pivoting vane region connected to the support beams with a flexible hinge member. The support beams can be fixedly or rotationally attached at one end to a foot pocket. Methods are provided for limiting the rotation of at least one of the pivoting vanes using flexible web members between vanes and the support beams. Methods for increasing lift and decreasing turbulence and drag on hydrofoils or vanes of the swim fins are also included.

24 Claims, 18 Drawing Sheets

(56) References Cited

U.S. PATENT DOCUMENTS

| | | | | |
|---|---|---|---|---|
| 5,634,613 | A | 6/1997 | McCarthy | |
| 5,746,631 | A | 5/1998 | McCarthy | |
| 6,290,561 | B1 | 9/2001 | Garofalo | |
| 6,746,292 | B2 | 6/2004 | Panzer | |
| 7,100,867 | B2 | 9/2006 | Houck, II | |
| 7,462,085 | B2 | 12/2008 | Moyal | |
| 7,735,774 | B2 | 6/2010 | Lugg | |
| 8,480,446 | B2 * | 7/2013 | Woods | 441/64 |
| 2009/0088036 | A1 | 4/2009 | Garofalo | |

* cited by examiner

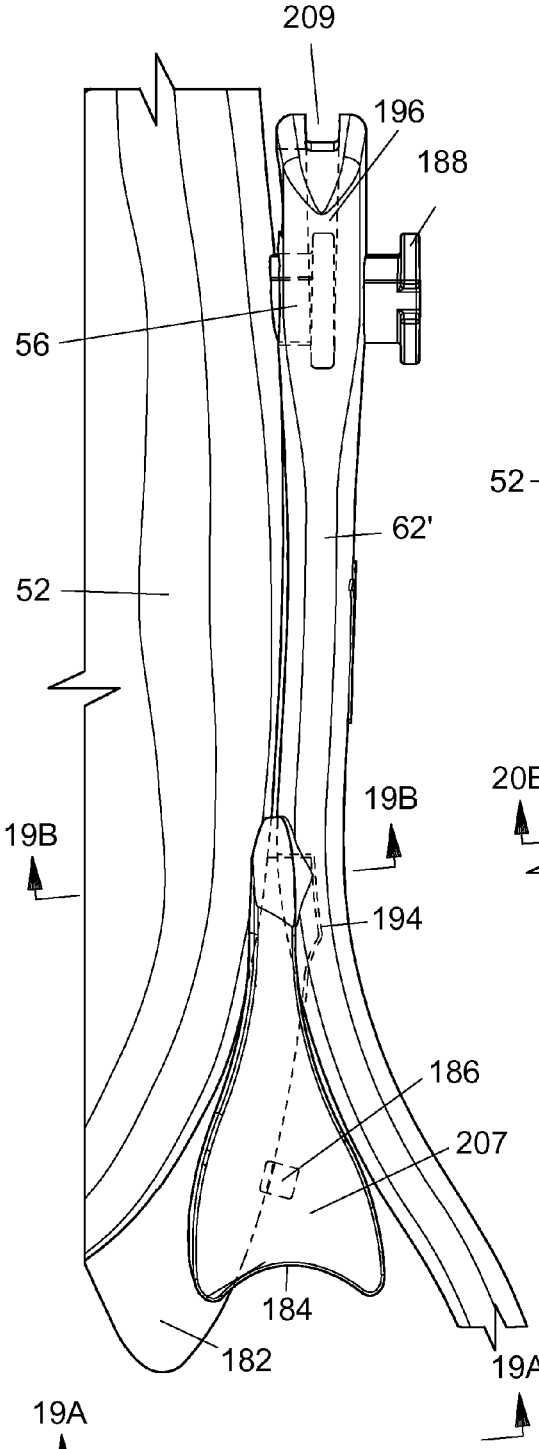
Fig. 17
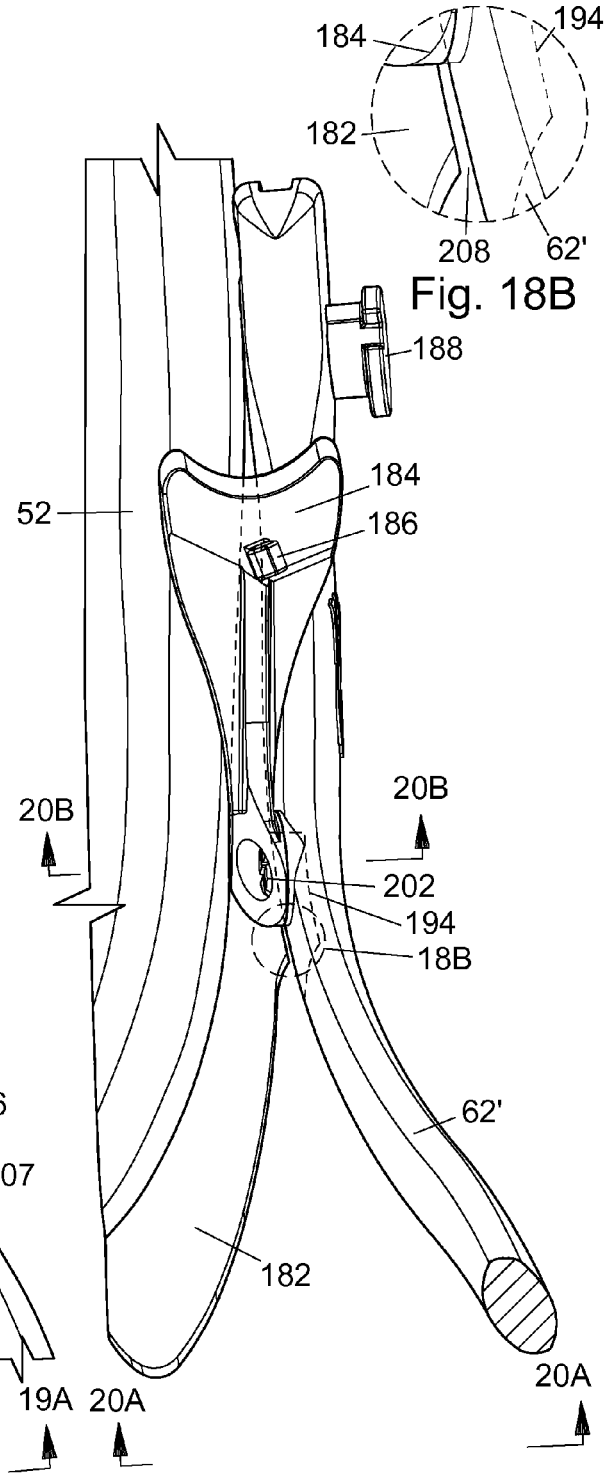
Fig. 18B
Fig. 18A

HIGH EFFICIENCY SWIM FIN USING MULTIPLE HIGH ASPECT RATIO HYDRODYNAMIC VANES WITH PLIABLE HINGES AND ROTATION LIMITERS

This invention is a Continuation-in-Part of U.S. patent application Ser. No. 12/939,393, filed Nov. 4, 2010, now U.S. Pat. No. 8,480,446, which claims the benefit of priority to U.S. Provisional Patent Application Ser. No. 61/280,375 filed Nov. 9, 2009, and U.S. Provisional Patent Application Ser. No. 61/646,679 filed May 14, 2012. The entire disclosure of each of the applications listed in this paragraph are incorporated herein by specific reference thereto.

FIELD OF INVENTION

This invention relates to swim fins, in particular to apparatus, devices and methods of using and operating multiple high aspect ratio hydrodynamic horizontal vanes with pliable hinge members and rotation limiting web members on swim fins.

BACKGROUND AND PRIOR ART

Over the years swimmers have been attempting to improve moving through water. Originally boards were attached to one's hands or feet, and have been used for over a hundred years with literally hundreds of variations. However, their hydrodynamic efficiency has been relatively poor in view of the difficulty of dealing with two human legs and allowing the fins to pass one another without collision. Current swim fins have evolved to an elongated flexible propulsion surface where their proliferation is mainly attributed to the ease of manufacture. All of these swim fins have suffered from problems of a very low aspect ratio and poor angle of attack. Other types of efficient swim assistance aids exist but have complexity and manufacturing costs that keep these aids from being used.

Earlier swim fin designs have problems with the aspect ratio and induced drag such as documented in U.S. Pat. No. 5,746,631 to McCarthy (1998) which is incorporated by reference. A substantial amount of induced drag is created by the transverse travel and vortex of fluid near the lateral edges of a lifting body (or foil) when that foil travels through a fluid. This induced drag reduces the effectiveness of the remainder of the foil. It has been established that a greater distance between the lateral edges improves the effective lift to drag ratio of the foil. The aspect ratio measures the separation of the lateral edges to the chord of the foil and is an indicator of the efficiency of the foil.

Most modern fins have an aspect ratio between 0.3 and 0.5. It is well known that a higher aspect ratio produces higher hydrodynamic efficiency. Many examples of this can be found in nature. Fish tails have widely varying aspect ratios. The fast swimming amberjack has a tail fin with an aspect ratio of about 8 while the much slower swimming grouper has an aspect ratio of about 1.5. Whales and dolphins have aspect ratios in the 5 to 6 range.

The angle of attack of a foil also affects the lift to drag characteristics of the foil. The angle of attack is the relative angle that exists between the actual alignment of the oncoming flow and the lengthwise alignment of the foil (or chord line). When this angle is small, the foil is at a low angle of attack. When this angle is high, the foil is at a high angle of attack. As the angle of attack increases, the flow collides with the foil's high pressure surface (also called the attacking surface) at a greater angle. This increases fluid pressure against this surface. While this occurs, the fluid curves around the opposite surface, and therefore must flow over an increased distance. As a result, the fluid flows at an increased rate over this opposite surface in order to keep pace with the fluid flowing across the attacking surface. This lowers the fluid pressure over this opposite surface while the fluid pressure along the attacking surface is comparatively higher. The pressure differential results in lift, or force causing it move in the direction of the low pressure.

A foil has an optimum angle of attack where the lift to drag ratio is the highest. When the foil is at a lower angle of attack than the optimum the lift is reduced with relatively little change in drag. When the foil is a higher angle of attack the drag increases substantially while the lift increases at a lesser rate. The increased drag is due to flow separation and the creation of turbulence on the low pressure side of the foil which is known as stalling. A typical optimum angle of attack for a foil is between 4 to 10 degrees. The angle of attack for most swim fins is 90 degrees which is in the stalled range and results in the swimmer having undue ankle stress and leg fatigue.

U.S. Pat. No. 2,729,832 to Schmitz described an improvement in efficiency by aligning the propulsion surface with the travel direction rather than the sole of the foot, but did not resolve low aspect ratio and extreme angle of attack having inefficiency created by vortices.

U.S. Pat. No. 107,376 to Hunter described a method for propelling ships using an oscillating rudder with multiple rubber propulsion vanes for ships.

U.S. Pat. No. 3,122,759 to Gongwer described improving performance with a very efficient high aspect ratio hydrofoil of about three feet laterally. The device resulted in propelling the swimmer in a straight line in open water but its size and complexity made it impractical for common sporting use.

U.S. Pat. No. 4,767,368 to Ciccotelli had a simpler high aspect ratio swim fin which was impractical for maneuvering in restricted areas and can cause significant stress on the swimmer's ankles due to the long lever arm from the ankle to the lifting vane. Generally, these high aspect ratio swim fins had protrusions which could snag underwater obstacles.

U.S. Pat. No. 4,781,637 to Caires described a high aspect ratio swim fin that required the swimmer to place both feet into the foot pocket requiring the swimmer to simultaneously kick both feet which was only useful in open water free of obstacles.

U.S. Pat. No. 4,178,128 Gongwer described a multi-vane hydrofoil shape swim fin to improve efficiency but required springs, hinges, and thin rods resulting in being mechanically complex, difficult to manufacture, prone to snagging underwater flora, and subject to abrasive wear from suspended grit.

U.S. Pat. No. 4,944,703 to Mosier showed a swim fin having multiple articulating hydrofoil vanes. However, the composite construction of internal rigid parts molded into less rigid parts resulted in expensive manufacturing costs. The 19 shown discrete parts in the figures indicate either manual assembly or a complex automated assembly line would be necessary resulting in expensive manufacturing costs. An implementation relied on pin and socket hinges and rubber inserts to control the articulation of the vanes which is subject to clogging and jamming by sand and other waterborne debris. The rigid side support beams would cause undue stress on the swimmer's ankles. The small gaps between the vanes and side beams and at the hinges are prone to trap stringy aquatic fauna and other stringy debris which may be encountered in the water creating a potential entrapment problem and a serious safety hazard.

An alternate embodiment in FIG. 6 of the Mosier '703 patent shows a resilient (rubber) hinge as the method of providing a rotational axis and self aligning of the vanes. However, this configuration would not work if physically constructed. Given the axial rotation desired of about 90 degrees as shown in FIG. 7 the axial length of the resilient hinge is too short to allow the rotation without overstressing the material and causing a shear failure. If the axial length were increased the narrow diameter would permit the vane to move out of alignment with the axis. The resilient hinge geometry has very high stress areas created at the interfaces between the softer and harder materials further increasing the likelihood of hinge failure. During operation, there would be no hard limit to the rotation of the vane. As more power is applied to the stroke, the vanes would rotate further reducing the effective lift of the vanes. Manufacturing would be difficult since five separately molded pieces would have to be hand placed in a second mold for the over molding process. Any manufacturing process which requires human interaction necessarily increases the cost.

U.S. Pat. No. 5,536,190 to Althen shows a propulsion method with an appropriate angle of attack using vane rotation limiters, high aspect ratio and plural vanes, but is hindered by many hinges and small parts which cause expensive manufacturing costs with the product prone to breakage and wear from captured grit. This device is impractical in aquatic environments since its parts can become entangled with flora.

U.S. Pat. No. 5,746,631 to McCarthy shows a fin with a longitudinal gap effectively creating a fin with propulsion surfaces which swing sideways during the power stroke. The apparatus reduces ankle stress but makes it difficult to attain higher rates of speed.

U.S. Pat. No. 3,084,355 to Ciccotelli uses narrow vanes which rotate along a transverse axis and are mounted parallel to each other in a direction that is perpendicular to the direction of swimming with vanes that are not hydrodynamically streamlined to generate lift, and no system is used to control tip vortices. The vanes are arranged so they only provide resistance to the kick during a small portion of the kicking stroke. When they are providing resistance they are effectively joined resulting in a lower aspect ratio vane than they are individually. Only two of the four vanes are functioning at any one time which leads to a cumbersome arrangement reducing the ability of the swimmer to control his attitude in a non-mobile condition. The device is overly complex and contains many small parts which are prone to corrosion, grit accumulation and snags.

U.S. Pat. No. 4,209,866 to Loeffler describes a thin pivotally mounted vane with reversibly effective streamline camber, but has a low aspect ratio which is known to have lower efficiency than higher aspect ratio vanes. The device was of complex construction with many wear points increasing the manufacturing and maintenance costs.

U.S. Pat. No. 5,330,377 to Kernek shows a swim fin with multiple connected surfaces creating channelized flow between them. The large surface area of the propulsion surfaces created sufficient viscous drag to cancel any gained benefit and the complex molding indicate a high fabrication cost.

U.S. Pat. No. 6,290,561 shows a swim fin with a propulsion surface supported by an elastic band and external beams. The elastic support restricts the maximum deflection of the propulsive surface but does nothing to control flow along the lateral surface edges. The edge vortices would create increased induced drag between the propulsion surface and support beams causing a reduction in efficiency compared to conventional swim fins.

U.S. Pat. App. 2009/0088036 to Garofalo shows a swim fin with restrained trailing edge and loose sides. The lack of a gap between the foot pocket and the vane eliminates the small benefit of its improved angle of attack. It includes "deformable folding side pockets which will be able not only to ensure a good "channel effect" but also to operate as deformation limiters." The long longitudinal length of the side pockets is sufficiently long that the vortex limiting capability is reduced. The volume of channelized flow is large enough that it creates a cushion effectively acting as a new hydraulic surface which forces the free flow to move laterally and create new edge vortices.

U.S. Pat. No. 5,634,613 to McCarthy shows tip vortex canceling devices and U.S. Pat. No. 3,411,165 to Murdoch and U.S. Pat. No. 4,738,645 to Garofalo use pleats with composite construction to increase local deflection of the propulsion surface. However, these swim fins have low aspect ratios with the problems previously described.

U.S. Pat. No. 4,981,454 to Klein and U.S. Pat. No. 7,462,085 to Moyal show swim fins with a hinge on the foot pocket allowing the propulsion surface to rotate upward against the swimmer's shin to facilitate simplified walking while wearing the device. However, these devices are limited in their efficiency since they use conventional flat low aspect ratio propulsion surfaces subject to all the problems previously described.

Hinges using rubber like substances to provide torsional resistance are shown in U.S. Pat. No. 2,987,332 to Bonmartini and U.S. Pat. No. 4,097,958 to Van Dell that use composites of rubber and metal. The metal provides support for the hinge while the rubber provides the torsional resistance. However, the metal parts are not practical in a salt water environment, and their geometry requires a relatively large area for the installation of the hinge which would reduce the area allotted for the attached vanes.

The ScubaPro Nova SeaWing swim fin uses a flexible support beam combined with a very flexible root section of the support beam which allows the entire support beam to rotate in excess of 30 degrees. Additional flexing of the support beam allows a total flex in excess of 40 degrees which is what is considered the optimum angle of attack. The SeaWing, while innovative, still suffers from adverse propulsion surface curvature, a low aspect ratio, the lack of a hydrodynamic lifting surface, and insufficient control of tip vortices.

In the field of aerodynamics it is well known that flow over a lifting body tends to drift toward the lateral tips of the body. That upper and lower surface tends to flow toward the wingtip. The portion of the flow which joins at the wingtip forms a vortex. The vortex creates induced drag which is not offset by increased lift and decreases the overall performance of the lifting body.

Many patents have been issued for systems to reduce the tip vortex problem. One effective approach to reduce the tip vortex is to encourage the lateral or spanwise flow to move toward the root of the wing by sweeping the outward end of the leading edge of the wing (wingtip) forward. Another technique is to lower the wingtip below the wing root.

Most wings are supported at the center by the fuselage of the aircraft. Because of this, both lateral flow reduction methods mentioned tend to undesirably reduce the stability of the aircraft. The subject swim fin provides support for the "wings" or vanes, as they will be called in regard to the present invention, at the wingtip of the vane and there is no central fuselage. Wingtip support allows the vane to be swept aftward or curved upward while actually enhancing the stability of the swim fin. The resulting redirection of the lateral flow toward the center of the vane improves the lift/drag ratio, decreases tip vortices, and concentrates thrust in a direction directly opposite the direction of travel of the swimmer.

Outward spanwise flow is commonly known in aeronautics is reported in prior patents. There are many patents which attempt to reduce the effect of this spanwise flow which manifests itself as tip vortices. However, there is no apparent application of the techniques to lifting bodies supported at the outer ends of the wings.

One of the earliest illustrations of a forward swept wing is found in U.S. Pat. No. 2,709,052 to Berg where the inventor attempts to control spanwise flow through manipulation of the location of the maximum foil thickness. This patent refers to conventional swept wings and forward swept wings, and uses an essentially conventional airfoil at the trailing portion of the wing and a fore-aft reversed airfoil at the leading portion. This reference states the natural tendency for spanwise flow to move spanwise toward the outward portion of the wing.

U.S. Pat. No. 4,146,199 to Wenzel describes an aircraft using both forward and rearward swept wings joined at the wing tips. The major argument for reduced tip vortices is the fact the two wing types are connected at the outboard ends. There is no mention of the spanwise flow directions on the wings.

U.S. Pat. No. 4,705,240 to Dixon illustrates spanwise flow toward the root of a forward swept wing in FIG. 3 and states the forward swept wing increases lift somewhat and moves the lift more toward the root. It is also stated the forward swept characteristic allows for a greater angle of attack without stalling. These two features would be beneficial to a swim fin vane. More lift is always good and moving the center of lift more toward the root (center in the case of these fins) centralizes the thrust. This assists in vane rotation and reduces lateral planing of the fin.

U.S. Pat. No. 4,767,083 to Koenig describes the benefits of forward swept wings (FSW) with the statement: "The flow on an FSW tends to separate first at the inboard section while good flow conditions can be maintained at the tip because of low induced angles of attack of the outer wing sections and because the air tends to flow toward the root rather than to the tip as it does on a sweptback wing. These flow conditions result in stall characteristics which allow the ailerons to remain effective at high angles of attack, even after most of the wing has stalled." This reinforces the probability a curved plan vane will be beneficial but makes no allusion to its use in a system where the tips of the wing are restrained and the center free to rotate.

U.S. Pat. No. 4,949,919 to Wajnikonis addresses the use of forward swept wings as directional control vanes on surfboards, and indicates the forward sweep moves the center of effort toward the root and reduces the tip vortex.

U.S. Pat. No. 6,746,292 to Panzer describes the use of forward swept wings starting in 1931 and cites the benefit as spanwise flow toward the root rather than the tip which increases the angle of attack at which a stall would occur near the tip or leading portion of the wing.

U.S. Pat. No. 7,100,867 to Houck is a variation on U.S. Pat. No. 4,146,199 with some of the rough edges smoothed out, and allows for a forward swept portion of the wing without a central fuselage. However, this reference does not teach of its use in articulated vanes on a swim fin.

U.S. Pat. No. 7,735,774 to Lugg illustrates spanwise flow toward the root of a forward swept wing in its FIGS. 5*a* and 5*b*, at low speeds below 60 knots. This, further, shows the lower the speed the more pronounced the spanwise flow.

Vaned fins with rubber hinges have a disadvantage when it comes to inserting them into mesh dive equipment bags. The combination of semi-rigid rails, soft webs and rigid vanes present a potential snagging problem for the rear-most vane. A support rail extending further than the web tends to get caught in openings of the dive bag.

Thus, the need exists for solutions to the above problems with the prior art.

SUMMARY OF THE INVENTION

A primary objective of the present invention is to provide apparatus, devices and methods of using and operating multiple high aspect ratio hydrodynamic horizontal vanes with pliable hinges and rotation limiters on swim fins used for swimmers or divers.

A secondary objective of the present invention is to provide apparatus, devices and methods of using and operating multiple high aspect ratio hydrodynamic horizontal vanes having few parts that are easy and inexpensive to manufacture.

A third objective of the present invention is to provide apparatus, devices and methods of using and operating multiple high aspect ratio hydrodynamic horizontal vanes which eliminates any snagging and abrasion in aquatic environments that were associated with closely associated moving parts used by fins in prior art aquatic environment.

A fourth objective of the present invention is to provide apparatus, devices and methods of using and operating multiple high aspect ratio hydrodynamic horizontal vanes that are easy to operate by swimmers in both salt water and fresh water applications, and has mobility on land.

A fifth objective of the present invention is to provide apparatus, devices and methods of using and operating multiple high aspect ratio hydrodynamic horizontal vanes that reduces stress on ankles and increases maneuverability of the swimmer, and increases efficiency of the effort of the swimmer, and increases foot angle efficiency.

A sixth objective of the present invention is to provide apparatus, devices and methods of using and operating multiple high aspect ratio hydrodynamic horizontal vanes that reduces tip vortex losses and results in a narrowly directed thrust.

A seventh objective of the present invention is to provide apparatus, devices and methods of using and operating multiple high aspect ratio hydrodynamic horizontal vanes that causes low environmental disturbances.

An eighth objective of the present invention is to provide apparatus, devices and methods of using and operating multiple high aspect ratio hydrodynamic horizontal vanes that uses reversible laterally flexible vanes.

A ninth objective of the present invention is to provide apparatus, devices and methods of using and operating multiple high aspect ratio hydrodynamic horizontal vanes that can be manufactured by a one piece overmolding process.

A tenth objective of the present invention is to provide apparatus, devices and methods of using and operating multiple high aspect ratio hydrodynamic horizontal vanes that can be injection molded in two steps.

An eleventh objective of the present invention is to provide apparatus, devices and methods of using and operating multiple high aspect ratio hydrodynamic horizontal vanes swept aft in plan to centralize thrust, improving efficiency.

A twelfth objective of the present invention is to provide apparatus, devices and methods of using and operating multiple high aspect ratio hydrodynamic horizontal vanes which are semi-flexible parallel to the fin longitudinal axis to centralize thrust, improving efficiency.

A thirteenth objective of the present invention is to provide apparatus, devices and methods of using and operating multiple high aspect ratio hydrodynamic horizontal vanes with an end configuration which prevents snagging on external objects.

The invention improves the efficiency of a swimmer or diver in self propulsion through water by increasing the aspect ratio of the propulsion surfaces of swim fins while using a more hydrodynamic shape and maintaining a narrow mechanism width to allow normal swimming action and keeping the manufacturing cost and maintenance requirements low. The invention groups multiple high aspect ratio hydrodynamic vanes into a single fin, arranged in a ladder form between two side support beams. These vanes would be allowed to rotate on a lateral axis during the kicking stroke but the rotation would be resisted by a pliable rubber like hinge. The maximum rotation would be limited by a flexible rubber like web connected between the vanes' lateral edges and the support beams. The limiting webs would also serve as winglets to cancel a significant amount of vortex creation at the vane ends. Ankle stress would be reduced through the use of flexible support beams which would flex as greater pressure is applied thus reducing the lever arm to the ankles without substantially reducing the effective thrust. The novel invention provides a controllable high efficiency swim fin which directs its thrust directly opposite the direction of travel without causing undue ankle stress or disturbance to the surrounding water. The pliable hinge eliminates the need for a conventional pin and hole type hinge which involves additional assembly steps during manufacture. The pliable hinge makes it possible to manufacture the entire mechanism through injection molding in two steps, a process known as overmolding. This results in a substantial reduction in production cost. The lack of closely associated moving parts eliminates snagging and abrasion associated with them in the aquatic environment. Unlike the prior art, this invention does not have closely associated moving parts and instead uses connections of flexible materials so there is no possibility of things getting caught between connected parts.

An embodiment of a novel fin apparatus for increasing the efficiency of a swimmer or diver during self propulsion through water, can include a plurality of high aspect ratio dynamic vanes arranged in a ladder configuration, each vane having a left end and a right end, two side beams, each arranged to both side ends of the ladder configuration of vanes, a plurality of pliable hinges that attach the ends of the vanes to the side beams, the pliable hinges allowing the vanes to rotate on a lateral axis during a kick stroke and be resisted by the pliable hinges, and a plurality of flexible webs that attach the ends of the vanes to the side beams, the flexible webs allowing for limiting a maximum rotation of the vanes, and serve as winglets to cancel a significant amount of vortex creation at the vane ends, wherein ankle stress is reduced through using the support beams which would flex as greater pressure is applied thus reducing the lever arm to the ankles without substantially reducing the effective thrust, resulting in a high aspect ratio, increasing the efficiency of the swimmer.

The pliable hinges can be formed from the group selected from one of rubber, silicone rubber, polyvinylchloride, Polyurethane, Polybutadiene, Chlorosulphonated Polyethylene, and neoprene.

The flexible webs can be formed from the group selected from one of: rubber, silicone rubber, polyvinylchloride, Polyurethane, Polybutadiene, Chlorosulphonated polyethylene, and neoprene, and the like.

The flexible side beams can be formed from the group selected from one of: Polyvinyl chloride, polypropylene, Acrylonitrile butadiene styrene, nylon, polyethylene, rubber and neoprene, and the like.

Each of the vanes can be a laterally o a oriented vane, and each of the vanes can be formed from the group selected from one of: Polyvinyl chloride, polypropylene, Acrylonitrile butadiene styrene, nylon, polyethylene, rubber and neoprene, and the like.

The pliable hinges can include a connection shaft attached at one end to one of the side beams and a second opposite end attached to one of the ends of the vane, and a pliable material overmolded over the connection shaft. Each of the pliable hinges can include a generally cylindrical or elliptical configuration with concave curved sidewalls. Each of the pliable hinges can have a generally cylindrical or elliptical configuration with concave curved sidewalls, and each of the flexible webs has a generally trapezoidal configuration. The pliable hinges can also be formed without a connection shaft.

The side beams can be flexible side beams as well as be rigid side beams, where flexible side beams can reduce stress and strain on the users' ankles.

The novel fin can include a foot pocket attached to one end of the side beams, and a pivoting portion for allowing the side beams with the vanes to flip up relative to the foot pocket, in order to allow the user to walk with the fins.

A novel method of improving the efficiency of a swimmer or diver in self propulsion through water, can include the step of increasing aspect ratio of propulsion surfaces of a swim fin while using a more hydrodynamic shape and maintaining a narrow mechanism width to allow normal swimming action and keeping the manufacturing cost and maintenance requirements low.

The step of increasing the aspect ratio can include the steps of grouping a plurality of high aspect ratio hydrodynamic vanes into a single fin, arranging the plurality of the vanes horizontally in a ladder configuration between side support beams, rotating the vanes along a lateral axis wherein rotation is limited by pliable hinges attached between each of the vanes and the side beams, and limiting maximum rotation of the vanes along the lateral axis by flexible webs that are attached between each of the vanes and the side beams. The limiting step can include the step of using the flexible webs as winglets to cancel significant amounts of vortex creation at the vane ends.

The method can further include the steps of providing flexible side support beams as the side support beams, and reducing ankle stress through the use of flexible beams which flex as greater pressure is applied and reduce the lever arm to ankles without substantially reducing the effective thrust.

The method can include the step of directing thrust with the fin opposite direction of travel without causing undue ankle stress or disturbance to surrounding water.

The method can further include the steps of providing a foot pocket attached to one end of the side beams, providing a pivoting member between the foot pocket and the one end of the side beams, and flipping up the side beams with the vanes in order to allow the user to walk while wearing the fins.

An embodiment of a novel fin apparatus for increasing the efficiency of a swimmer or diver during self propulsion through water, can include a plurality of high aspect ratio dynamic vanes which are curved in plan view such that the center of the vane is aft of the outward edges of the vane arranged in a ladder configuration, each vane having a left end and a right end, two side beams, each arranged to both side ends of the ladder configuration of vanes, a plurality of pliable hinges that attach the ends of the vanes to the side beams, the hinges allowing the vanes to rotate on a lateral axis during a kick stroke and be resisted by the pliable hinges, and a plurality of flexible webs that attach the ends of the vanes to the side beams, the flexible webs allowing for limiting a maximum rotation of the vanes, and serve as winglets to cancel a significant amount of vortex creation at the vane ends, wherein ankle stress is reduced through using the support beams which would flex as greater pressure is applied thus reducing the lever arm to the ankles without substantially reducing the effective thrust, resulting in a high aspect ratio, increasing the efficiency of the swimmer.

An alternate approach to reducing spanwise flow is to allow vanes which are semi-flexible parallel to the fin longitudinal axis to flex in the direction opposite of that of the applied force effectively creating an anhedral similar to that of the wings of an albatross. Flow passing around the lowered wing tip tends to move inward toward the higher wing root. In the situation of the subject fin vanes where the wing tips are the point of support the flow tends to move from those constrained wing tips toward the centerline of the vane. The amount of curvature controls the magnitude of this effect.

For the purpose of this invention a fairly minimal curvature is used to cancel the effect of outward spanwise flow. An added benefit is the relocation of the center of lift as the vane bends. The center of lift always moves to the leading side of the rails creating a stability enhancing effect. Flat vaned fins have a tendency to slide sideways because the center of lift is very near the center of effort of the kick. This shift in center of lift has an effect similar to placing of ballast in the bottom of a boat to reduce its rocking. Of course this approach could be combined with the curved vanes but it is expected both would be applied to lessor degrees to prevent excessive inward spanwise flow.

An embodiment of a novel fin apparatus for increasing the efficiency of a swimmer or diver during self propulsion through water, can include a plurality of high aspect ratio dynamic vanes which are semi-flexible parallel to the fin longitudinal axis, arranged in a ladder configuration, each vane having a left end and a right end, two side beams, each arranged to both side ends of the ladder configuration of vanes, a plurality of pliable hinges that attach the ends of the vanes to the side beams, the hinges allowing the vanes to rotate on a lateral axis during a kick stroke and be resisted by the pliable hinges, and a plurality of flexible webs that attach the ends of the vanes to the side beams, the flexible webs allowing for limiting a maximum rotation of the vanes, and serve as winglets to cancel a significant amount of vortex creation at the vane ends, wherein ankle stress is reduced through using the support beams which would flex as greater pressure is applied thus reducing the lever arm to the ankles without substantially reducing the effective thrust, resulting in a high aspect ratio, increasing the efficiency of the swimmer.

An embodiment of a novel fin apparatus for increasing the efficiency of a swimmer or diver during self propulsion through water, can include a plurality of high aspect ratio dynamic vanes, arranged in a ladder configuration, each vane having a left end and a right end, two side beams, each arranged to both side ends of the ladder configuration of vanes, a plurality of pliable hinges that attach the ends of the vanes to the side beams, each end of the side beams terminating prior to the rear most edge of the rear most vane, the hinges allowing the vanes to rotate on a lateral axis during a kick stroke and be resisted by the pliable hinges, and a plurality of flexible webs that attach the ends of the vanes to the side beams, the flexible webs allowing for limiting a maximum rotation of the vanes, and serve as winglets to cancel a significant amount of vortex creation at the vane ends, and a convex curved trailing edge of the rear most flexible webs, wherein the probability of snagging external object is reduced, ankle stress is reduced through using the support beams which would flex as greater pressure is applied thus reducing the lever arm to the ankles without substantially reducing the effective thrust, resulting in a high aspect ratio, increasing the efficiency of the swimmer.

Other combinations of the individual aspects of each embodiment would also be possible.

Further objects and advantages of this invention will be apparent from the following detailed description of the presently preferred embodiments which are illustrated schematically in the accompanying drawings.

BRIEF DESCRIPTION OF THE FIGURES

FIG. 17 is a plan view of a latching system for the pivotally attached support beam embodiment with the cam lever in the latched position.

FIG. 18A is a plan view of a latching system for the pivotally attached support beam embodiment with the cam lever in the un-latched position.

FIG. 18B is a detail of FIG. 18A showing the gap created when the cam lever is operated.

DESCRIPTION OF THE PREFERRED EMBODIMENTS

Figure 1:
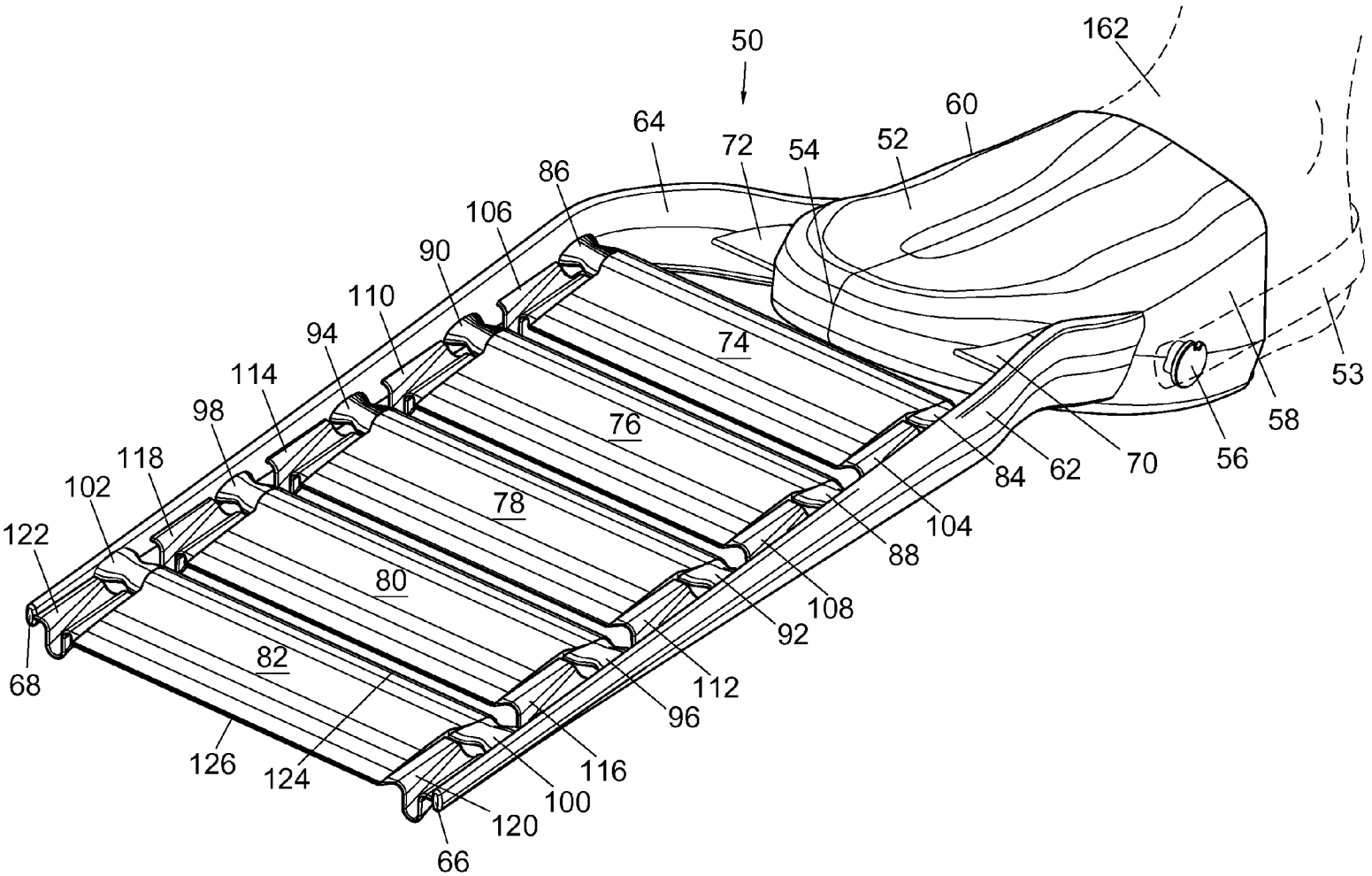
FIG. 1 is a perspective view of a first embodiment of the novel fin apparatus invention.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

This invention claims the benefit of priority to U.S. Provisional Patent Application Ser. No. 61/280,375 filed Nov. 9, 2009, which is incorporated by reference.

A list of the components will now be described.

50 symmetric vane fixed support beam swim fin
52 foot pocket
53 foot strap
54 toe portion
56 foot strap peg
58 left side
60 right side
62 support beam L
64 support beam R
66 end portion L
68 end portion R
70 flow guide L
72 flow guide R
74 vane 1
76 vane 2
78 vane 3
80 vane 4
82 vane 5
84 pliable hinge 1 L
86 pliable hinge 1 R
88 pliable hinge 2 L
90 pliable hinge 2 R
92 pliable hinge 3 L
94 pliable hinge 3 R
96 pliable hinge 4 L
98 pliable hinge 4 R
100 pliable hinge 5 L
102 pliable hinge 5 R
104 pliable web 1 L
106 pliable web 1 R
108 pliable web 2 L
110 pliable web 2 R
112 pliable web 3 L
114 pliable web 3 R
116 pliable web 4 L
118 pliable web 4 R
120 pliable web 5 L
122 pliable web 5 R
124 leading edge
126 trailing edge
128 connection shaft
130 beam hinge base

132 vane hinge base
134 vane hinge hole
136 web connection slot
138 web connection rail
140 beam hub
142 beam hub wing
144 beam hub wing hole
146 hinge axis point
148 oblong hole
150 front of web
154 connection bump
156 flow
158 user's leg
160 heel
162 foot
164 maximum flexure
166 direction of foot motion
168 support beam deflection
170 lift
171 laterally flexible vane fixed support beam swim fin
172 flexible connector
174 rigid leading edge
176 rigid trailing edge
178 rail system
180 laterally flexible vane
182 latch ledge
184 cam
186 lock clip
188 replacement foot strap peg
190 cam lever rotation
192 beam rotation
194 latch slot
196 foot strap peg receptacle
198 keyway
200 tab
202 cam lever post
204 shoulder
206 cam pivot hole
207 broad upper surface
208 gap
209 receptacle back opening
210 symmetric vane pivotally attached support beam swim fin
212 left latch assembly
214 right latch assembly
216 laterally flexible vane pivotally attached support beam swim fin
218 symmetric planar curved vane pivotally attached support beam swim fin
220 hinge point L
222 hinge point R
224 elongated support beam L
226 elongated support beam R
228 cross beam
230 planar curved vane 1
232 planar curved vane 2
234 planar curved vane 3
236 planar curved vane 4
238 planar curved vane 5
240 trailing edge
242 tapered end portion L
244 tapered end portion R
246 convex curved trailing edge L
248 convex curved trailing edge R
250 propulsion assembly
252 lock receptacle
254 longitudinal axis
256 centerline flow
258 outward edge flow
260 center of lift
262 axis of rotation
264 pliable hinge-web assembly
266 overmolded pliable material
268 trailing edge hinge-web assembly
270 longitudinally semi-flexible vane

First Embodiment

FIG. 1 is a perspective view of a first embodiment of the novel fin apparatus invention showing a fixed rail swim fin 50. A foot pocket 52 can include a common usage foot strap 53. Foot pocket 52 can include a toe portion 54 and one of a pair of outwardly extending lateral foot strap peg 56. Foot pocket 52 further defines a left side 58 and right side 60. Fixedly attached to the left side 58 and right side 60 of the foot pocket 52 can be a pair of elongated support beams 62 and 64 which extend toward the toe portion 54 of the foot pocket 52 and terminate in rounded end portions 66 and 68 respectively. A pair of flow guides 70 and 72 can extend laterally between the foot pocket 52 and support beams 62 and 64 respectively.

The support beams 62 and 64 are generally parallel and define therebetween a uniform space. A plurality of hydrofoil vanes 74, 76, 78, 80 and 82 can be pivotally secured between support beams 62 and 64 by a plurality of pliable hinges 84, 86, 88, 90, 92, 94, 96, 98, 100 and 102. The first embodiment can have five vanes 74-82 that are each pivotally supported by pairs of pliable hinges 84-102. The hydrofoil vane 74 nearest the toe portion 54 is secured by a pliable hinge 84 to support beam 62 and by a pliable hinge 86 to support beam 64. Similarly, vane 76 is secured by pliable hinges 88 and 90 to support beams 62 and 64 respectively and vanes 78, 80, and 82 are secured to support beam 62 by pliable hinges 92, 96, and 100 respectively and to support beam 64 by pliable hinges 94, 98, and 102 respectively. Each hydrofoil vane 74 through 82 can also be flexibly attached to support beams 62 and 64 by a plurality of pliable webs 104, 106, 108, 110, 112, 114, 116, 118, 120 and 122 which are described in greater detail below. The hydrofoil vane 74 nearest the toe portion 54 is secured by a pliable web 104 to support beam 62 and by a pliable web 106 to support beam 64. Similarly, vane 76 is secured by pliable webs 108 and 110 to support beams 62 and 64 respectively and vanes 78, 80, and 82 are secured to support beam 62 by pliable webs 112, 116, and 120 respectively and to support beam 64 by pliable webs 114, 118, and 122 respectively. In accordance with an important aspect of the present invention and as is described below in greater detail, hydrofoil vanes 74 through 82 define high aspect ratio hydrofoils in which their individual transverse or lateral dimensions are substantially greater than their widths in the flow direction.

The cross section of the five shown hydrofoil vanes 74 through 82 generally conform to airfoil shapes NACA (National Advisory Committee of Aeronautics) 0009 to NACA 0012. alternative airfoil shapes having high aspect ratios could also be used. Support beams 62 and 64 defines a plurality of molding connection points which are hidden from view under the pliable hinges 84-102 and pliable webs 104-122 in FIG. 1 and are shown and described in subsequent figures. The lateral ends of the vanes also contain a plurality of molding connection points which are hidden from view under pliable hinges 84-102 and pliable webs 104-122 in FIG. 1, and are also shown and described in subsequent figures.

A preferred embodiment of the novel swim fin 50 can be fabricated from a resilient semi-rigid molded plastic or rubber material and a more pliable plastic or rubber for the pliable hinges 84-102 and pliable webs 104-122. Alternatively, other materials resulting in similar results can be used.

The foot pocket 52 can receive the swimmer's foot such that the swimmer's foot 162 extends into interior cavity with the swimmer's toes situated within toe portion 54 after which it is secured by a strap system 53 to foot strap peg 56 that is known in the field. In accordance with conventional swim fin fabrication techniques, the strap system 53 can include an adjustment to accommodate foot size variations. Furthermore, the axes of support beams 62 and 64 in their elongated direction can be angularly displaced with respect to foot pocket 52 in a downward direction. This angular displacement can be seen in FIGS. 6A-10C and is to compensate for the typical angular relationship between a swimmer's leg and foot due to the restriction of ankle movement. As a result, support beams 62 and 64 are generally aligned with the swimmer's leg for more efficient stroking action.

The novel hydrofoil vanes 74-82 can be secured with pliable hinges 84 through 102 in a limited travel pivotal attachment in which hydrofoil vanes 74-82 are pivotally movable about their respective pliable hinges 84 through 102 within a limited angular motion which is restricted by their respective pliable webs 104-122. The vanes 74-82 are torsionally biased to assume the position shown in FIG. 1 in which the vanes 74-82 are substantially aligned with the major axis of support beams 62 and 64. In the absence of a stroking motion, this torsionally biasing force operative upon vanes 74-82 urges the vanes to the aligned position shown in FIG. 1.

The pivotal attachments of vanes 74-82 to support beams 62 and 64 can be positioned forward of the center lines of the hydrofoil vanes 74-82 at approximately 15% of the chord distance from the leading edge 124 toward the trailing edge 126 of each vane. Accordingly, substantial motion of the present invention swim fin in either direction causes vanes 74-82 to be pivoted to a desired angular position with respect to support beams 62 and 64. While the pivotal action of vanes 74 through 82 described in detail, the hydrofoil vanes 74-82 align with the appropriate angle of attack in response to the hydrodynamic pressure created during the movement of the fin through the water. The pivotal motion of the hydrofoil vanes 74-82 to the desired angle of attack simultaneously reduces the resistance of the water against fin motion thereby making the stroke easier for the swimmer and concurrently develops a localized area of higher flow velocity and reduced pressure along the front sides of each of the hydrofoil vanes. The reduced pressure on the front sides of the hydrofoil vanes 74-82 then produces a forward thrust component for increased efficiency of the swim fin.

During each stroke of swim fin the motion of the swim fin through the water aligns vanes 74-82 at the appropriate angle and the stroke action causes a flow of water across the angled vanes 74-82 producing a forward thrust carrying the swimmer forward. In the event of a small motion of the swim fin in either direction the torsional resistance of the pliable hinges 84-102 allows the vanes 74-82 to rotate partially toward the desired angular position and, in doing so, allows flow between the vanes 74-82 creating a smaller amount of forward thrust through the hydraulic mechanics previously described.

FIGS. 2A, 2B, 2C, 2D and 2E show a representative portion of support beam 62 and vane 82 showing the attachment surfaces for the pliable hinges and pliable webs that are not shown. These figures show the connection at pliable hinge 100 and pliable web 120 as shown in FIG. 1. The vane 80 nearer the foot pocket in FIG. 1 is not shown for clarity. All of the other attachment pliable hinge and pliable web locations are similar.

Figure 2A:
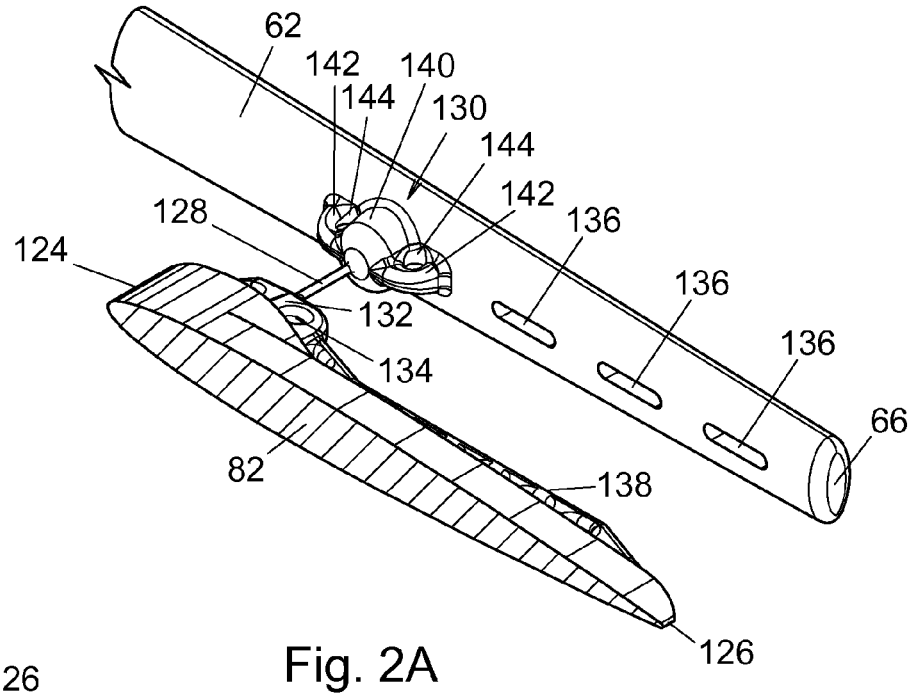
FIG. 2A is an isometric view of one vane-beam connection with the outer pliable hinge and pliable web removed for visibility.
Figure 2B:
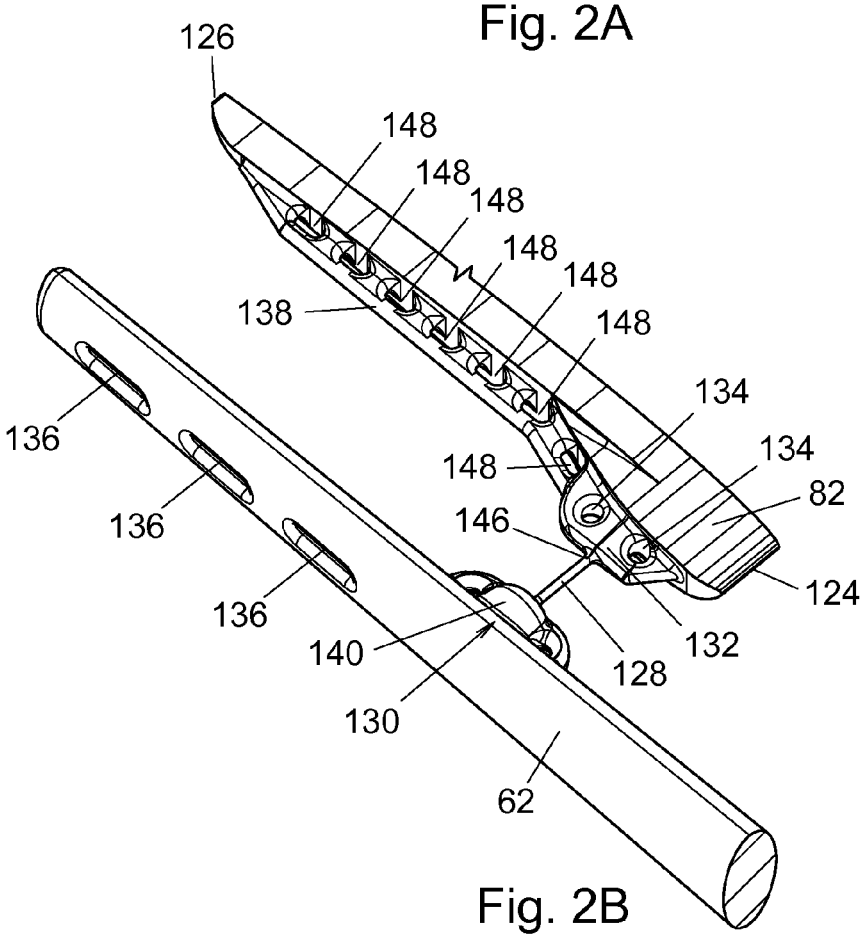
FIG. 2B is an isometric overhead view of the one vane-beam connection of FIG. 2A.
Figure 2C:
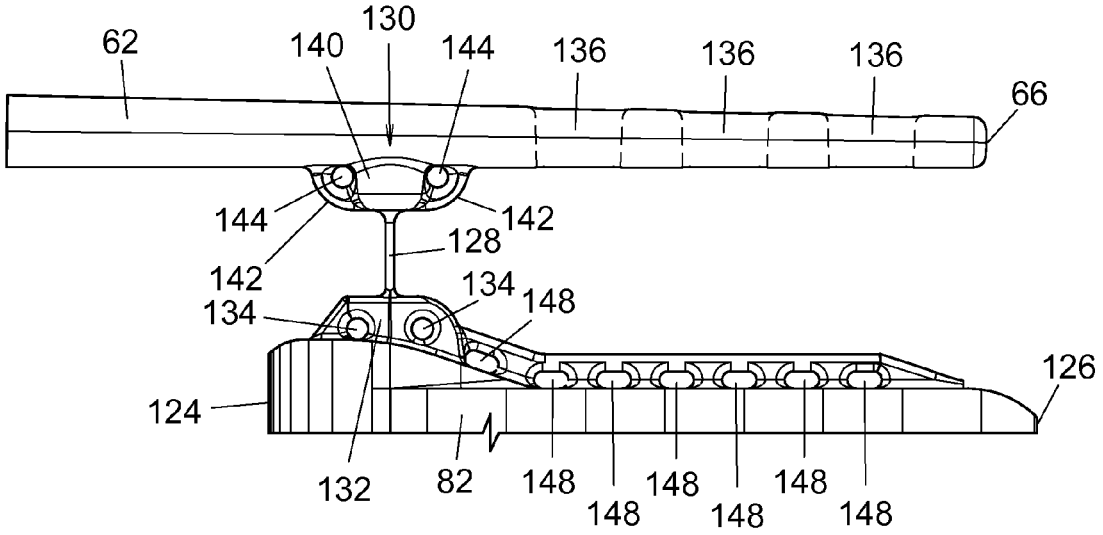
FIG. 2C is a plan view of the one vane-beam connection of FIG. 2A.
Figure 2D:
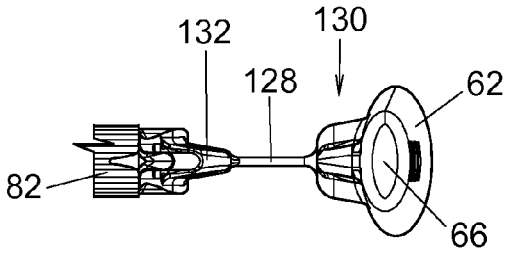
FIG. 2D is a rear view of the one vane-beam connection of FIG. 2A.
Figure 3:
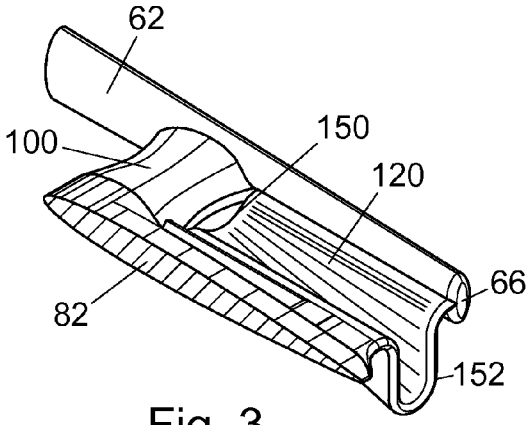
FIG. 3 is an isometric view of the novel pliable hinge and pliable web interconnection between the support beam and vane in a neutral position.

A hinge base 130 can be centered at the location on the support beam 62 which would be laterally aligned with the hinge axis point 146 (shown in FIG. 2B) of the vane 82. The hinge base 130 can include a beam hub 140 with two hub wings 142 with holes 144 through each as described below. The rail hub 140 can have a tapered cylindrical shape with a height equivalent to approximately ¼ of the gap between the support beam 62 and the vane 82 with a diameter such as to provide sufficient coverage by the hinge pliable material (not shown) to prevent tearing under stress. The covering thickness can depend on the specific material used and expected rotation of the pliable hinge 100 (FIG. 3).

Figure 4A:
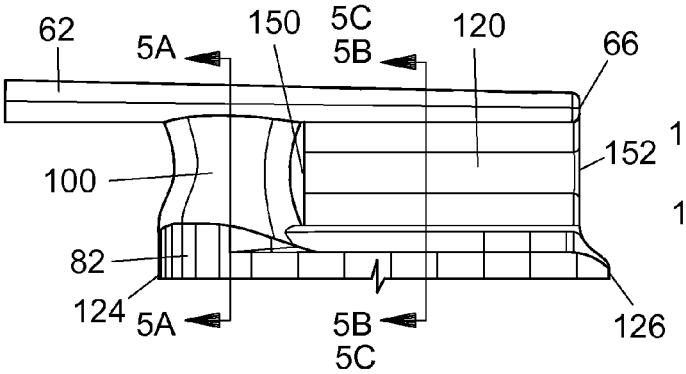
FIGS. 4A, 4B and 4C are plan profile and side views of the novel pliable hinge and pliable web interconnection and the support beam and vane of FIG. 3 in its neutral position.

Connected to the rail hub 140 and in line with the longitudinal axis of the support beam 62 can be a pair of hub wings 142 on opposing sides of the rail hub 140. Their thickness is about half of their height and their height can be equivalent to that of the rail hub 140. The hub wings 142 can be rounded on their free corner with a radius equivalent to the height of the rail hub 140. Each hub wing 142 can be pierced perpendicular to its major plane by a hole 144 with a diameter equivalent to half of the height of the hub wing 140. The holes 144 can provide for a mechanical connection of the pliable material of the pliable hinge 100, FIG. 4A. The hinge base 130 can be connected to the vane hinge base 132 by an elongated connection shaft 128 extending laterally from the top of the rail hub 140. On both sides of the vane hinge base 132 can be vane hinge holes 134.

The diameter of the connection shaft 128 can be the minimum sufficient to allow plastic material to flow through the mold tool. The connection shaft 128 serves the purpose of holding the parts together during the molding process and it should be sufficiently small in diameter to allow it to twist through a rotation of about 90 degrees repeatedly without breaking. Alternatively, the shaft 128 can be allowed to break after a number of articulations but the shaft 128 is at the center of rotation of the pliable hinge 100 so it will have no effect on the effectiveness of the pliable hinge 100.

Figure 5A:
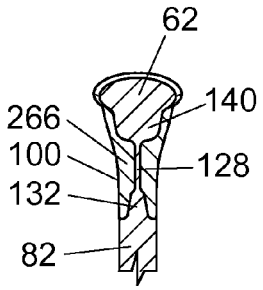
FIGS. 5A-5B are cross-sectional views of FIG. 4A showing the overmolding of the pliable material.
Figure 5B:
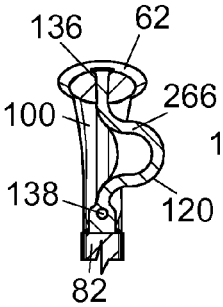

All the edges can be rounded to reduce stress concentration in the overmolded pliable material 266 FIG. 5B. While this description covers a configuration of the hinge bases, 130, 132 other geometries can be used to accomplish a similar function and this invention is not dependant on this particular configuration.

This first embodiment illustrates the substructure necessary in the event a simple fusion bond between the firm and pliable materials is not sufficiently strong by itself to prevent separation of the materials when under stress. An alternate configuration is described in FIG. 5C where the fusion bond alone is sufficiently resilient. A key element in reduction of the manufacturing cost is minimizing the handling of individual pieces of the unfinished product. To this end all of the firm parts are intended to be injection molded at one time and are connected to each other. The connection is clearly shown as the connection shaft 128.

Laterally piercing the support beam 62 between the hinge base 130 and end portion 66 are web connection slots 136 with a thickness approximately equivalent to the thickness of the pliable web 120. Opposite the slots 136 can be a web connection rail 138 on the vane 82. The slots 136 a length of about 1.5 times the spacing between the slots 136 to assure sufficient material remains in the support beam 62 to minimize structural degradation of the support beam 62.

Figure 2E:
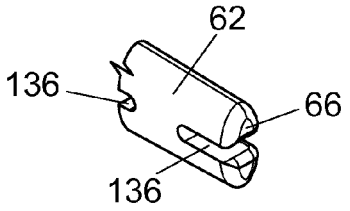
FIG. 2E is an isometric view of the one vane-beam connection of FIG. 2A with an alternate web slot configuration.

A preferred version shown in FIG. 2E would be enhanced by having one slot 136 piercing the end portion 66 to provide better support for the overmolded pliable material 266 FIG. 5B.

FIG. 2B shows FIG. 2A from another overhead vantage point which makes the edge of the vane 82 more visible. Centered on the hinge axis point 146 at approximately 15% of the chord length of the vane 82 from the leading edge 124 is the vane hinge base 132 which is described below in greater detail. The vane hinge base 132 is a part of the vane 82 on the lateral edge which is a protrusion with a height of approximately'/of the lateral width of the pliable hinge and with a thickness which is similar to the thickness of the vane 82 at the hinge axis point 146 less the required thickness of the pliable hinge material overlay as described and shown in FIG. 2A. The longitudinal length of the vane hinge base 132 is approximately three to four times its height and it is rounded on the free corners. A plurality of holes 134 can pierce the vane hinge base 32 to create additional mechanical connection between the vane 82 and overmolded pliable material 266 FIG. 5B.

A web connection rail 138 runs along the centerline of the lateral edge of the vane 82 the height of which is approximately two times the thickness of the pliable web 120 and is perforated with oblong holes 148 half of the connection rail height. The connection rail 138 tapers to no height near the trailing edge 126. Since the connection rail 138 provides additional stiffness to the pliable web 120 the connection rail 138 is on a base which is offset from the support beam 62 an additional distance approximately equivalent to the height of the rail 138.

The first embodiment of the swim fin 50 as shown in FIG. 1 improves human in water self propulsion by utilizing the benefits of high aspect ratio vanes while maintaining a relatively narrow overall width. Initially the swim fin operates similar to many swim fins already available in the marketplace. It has a foot pocket 52 for attachment to the user's foot with a foot strap 53 to keep it attached during use. This feature is common to most swim fins and is not considered unique in this invention but a base on which the other features are built. Beams 62, 64 attached to the left side 58 and right side 60 of the foot pocket 52 serve as support frame for the hydrodynamic vanes 74-82. In this embodiment the beams 62, 64 are essentially parallel to allow all the vanes 74-82 to be equal in width but that feature is not necessary for the overall function of the invention. Some variation in the width between the beams 62, 64 for aesthetic purposes would not substantially degrade the performance of the invention.

Figure 7A:
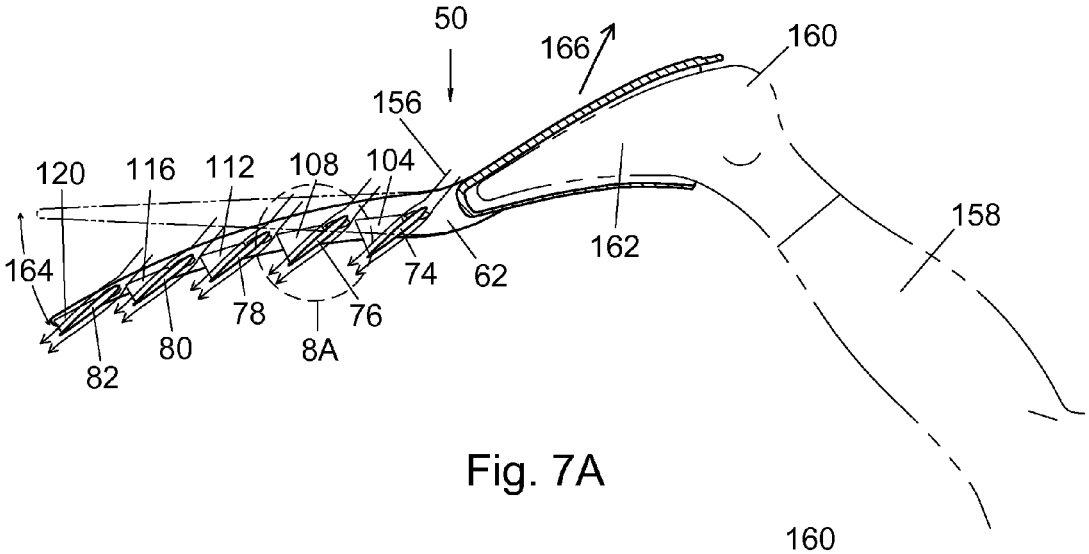
FIGS. 7A, 7B and 7C show an operational sequence of the first embodiment of the preceding figures using symmetrical rigid vanes.
Figure 7B:
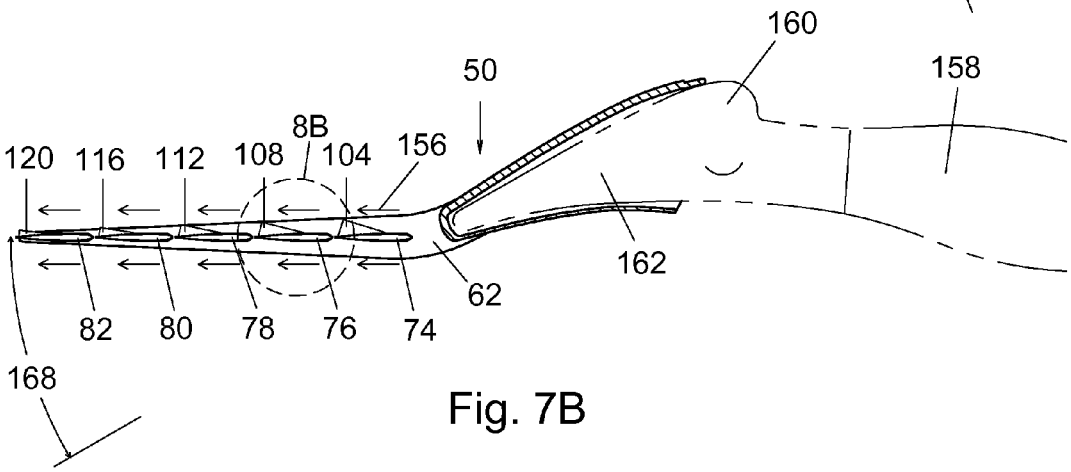
Figure 10A:
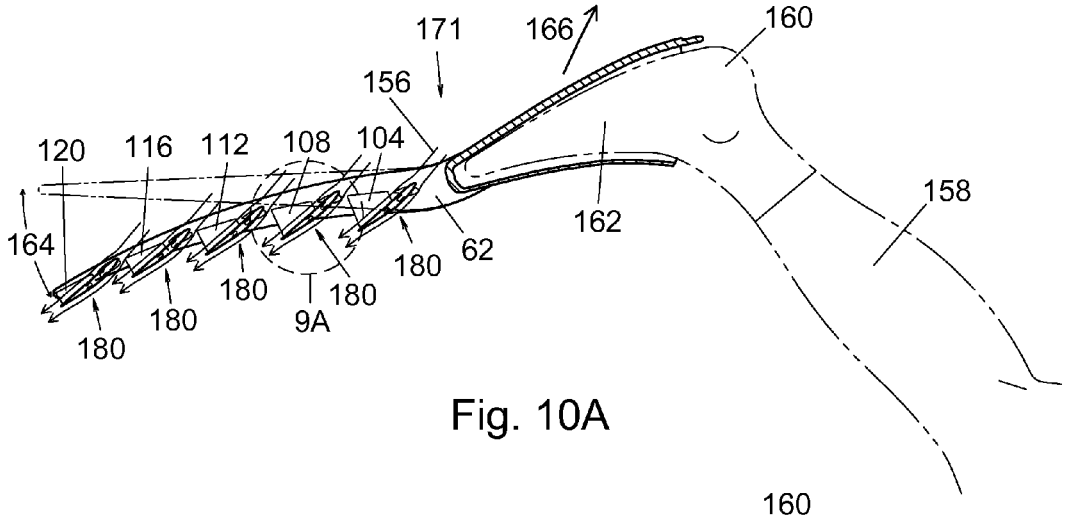
FIGS. 10A, 10B and 10C show the operational sequence of another embodiment of the invention using symmetrical laterally flexible vanes.
Figure 10B:
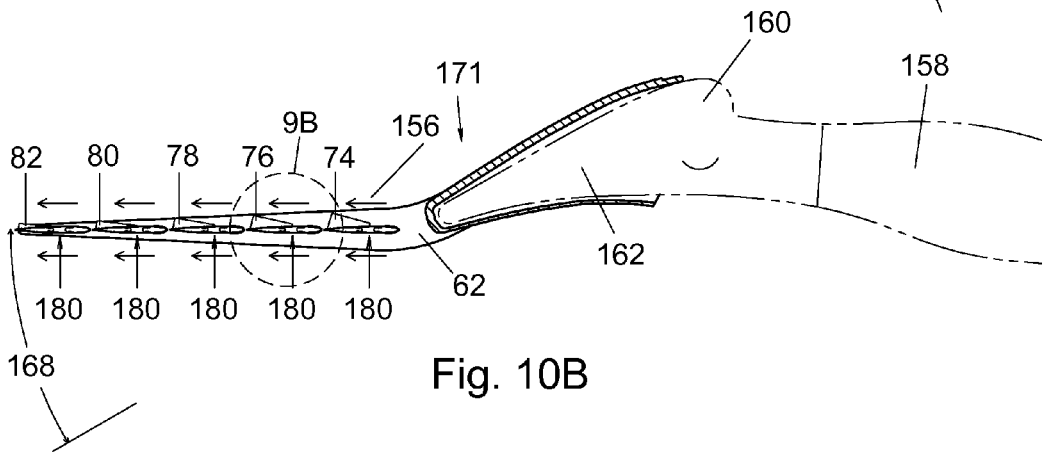

Because the user's foot 162 is not normally in line with the direction of travel of the user, the support beams 62, 64 deflect downward about 30 degrees such that they are substantially aligned with the axis of the user's leg 158 (FIG. 7B or 10B) when in a neutral position such as when coasting as shown in FIGS. 7B and 10B.

It is well known that an improperly sized swim fin will not perform well regardless of how efficient it is. Testing has revealed a total projected propulsive surface area of approximately 90 to approximately 100 square inches provides a comfortable balance between propulsive effort and actual forward speed. It is also known the width of a swim fin assembly should not exceed approximately 9.5 inches for widths in excess of this often collide during use. Consequently, the composite length of the vane array is the desired propulsive area divided by the available width between the support beams 62, 64.

The number of vanes 74-82 can be determined by the strength of the materials selected for their construction and the vane thickness to chord ratio. Stronger materials will allow thinner vanes. Computational fluid dynamics computer modeling of various vane shapes has revealed lift to drag ratios improve as the thickness to chord ratio decreases.

Given the limitations of unreinforced plastic like materials it was found that NACA (National Advisory Committee of Aeronautics) 0009 to NACA 0012 airfoils work well. The NACA airfoil 4 digit designation describes the shape of an airfoil based on its camber as a percentage of the chord (first 2 digits) and the maximum thickness (occurring at 30% of the chord) as a percentage of the chord length (last 2 digits). Thus a NACA 0009 airfoil is symmetrical (00) with a maximum thickness of 9% of the chord length (09). NACA is not the only designation for airfoil shapes and not all airfoil shapes have been tested so there can be other airfoil shapes which could also be applied to this invention. Division of the actual vane thickness required given the materials selected by the vane thickness to chord ratio of the airfoil shape will then yield the physical chord of the vane. Dividing the length of the propulsive area by the airfoil chord length will reveal the number of vanes which can be installed.

A major problem with previous swim fin designs is the angle of attack of the propulsive surface which is resolved with this invention by separating the propulsive surface or vanes 74-82 from the foot pocket 52 and allowing them to rotate toward the direction of foot motion 166 (FIGS. 7A, 7C, 10A, 10C). This is accomplished by pivotally connecting the vanes 74-82 to the support beams 62, 64. The problem of limiting the vane rotation to the optimum angle of attack is resolved by connecting the rearward portion of the lateral edges of the vanes 74-82 to the support beams 62, 64 with the limiting pliable webs 104-122 shown in FIG. 1.

In the past post and hole type hinges were used to allow rotation of the vanes but these were subject to problems of grit inclusion and snagging of waterborne debris. Additionally, a free swinging hinge would necessarily allow portions of the swimming stroke where no propulsive force would be generated. That portion is mostly during the transition in direction of the stroke where the vane pivots between the optimal angle of attack in one direction to the optimum angle of attack in the opposite direction. Videos of testing has revealed this transition portion to include as much as 30% of the stroke. All three of these issues were resolved through the use of the novel pliable hinges 84-102 shown in FIG. 1.

The novel pliable hinges 84-102 have no sliding interface to get clogged with grit, no gaps to allow snagging of waterborne debris, and the vanes 74-82 are always torsionally biased to the neutral position providing some lift component even during the transitional stages of the swimming stroke. The torsional bias to the neutral position provides another benefit of encouraging some propulsive lift with small foot movements. Small foot movements are often used by swimmers while remaining stationary to maintain one's attitude in the water or for maneuvering.

FIGS. 2A-6D show the construction of the pliable hinge 100 and pliable web 120. Previously, all multivane swim fin devices have relied on many discrete parts and often small parts. The interfaces between these parts have often involved relative motion in contact resulting in wearing surfaces and subsequent part failure. Few of the previous multivane swim fin devices have made it to commercial production due to the high production cost involved with assembly of multiple parts. The subject invention uses a common two step overmolding process to fabricate the entire swim fin as a single part thus eliminating much of the previously required fabrication costs.

One of the key elements to inexpensive overmolding is maintaining the alignment of the parts as they are transferred from one mold tool to the next. This is accomplished with the connection shaft 128 between the support beam 62 and vane 82 as shown in FIGS. 2A-2D. This shaft 128 can be sized as small as possible to allow support of the parts during handling, allow repeated pivot about its axis up to 90 degrees, and allow molding material to flow through without creating a cold joint. Due to the torsional resistance created by the pliable hinge it is necessary to assure a good bond between the pliable hinge 100 and the support beam 62 and vane 82. To this end the beam hinge base 130 is formed on the support beam 62 and the vane hinge base 132 is formed on the lateral edge of the vane 82. These bases 130, 132 serve to increase the surface area for bonding contact and holes 134, 144 through the bases provide additional mechanical bonding. The bases 130, 132 shown here are only one example of a method to improve bonding between two materials, there are others methods which will also work and this invention is not limited to this single example. The pliable web 120 is subject to substantial tension and flexural stresses where they bond to the support beam 62 and vane 82. To accommodate these stresses web connection slots 136 are incorporated in the support beam 62 and a web connection rail 138 is incorporated into the vane(s) 82. These provide increased surface area for bonding contact. Holes 148 through the web connection rail 138 provide additional mechanical bonding to the pliable web 120. The spacing of the web connection slots 136 is such as to cause little decrease in the flexural properties in the support beam 62.

FIG. 3 shows the neutral position of the pliable hinge 100 and pliable web 120 installed over the features in FIG. 2 attached to the support beam 62 and vane 82. The nominal thickness of the material for the pliable web 120 can vary depending on the particular substance from which it is fabricated. If it were made out of neoprene the thickness of the pliable web 120 would be approximately 0.07 inches. Other materials or even fabric could be used for this feature and would have a substantial effect on the necessary thickness and attachment method.

The pliable web(s) 120 can have a generally trapezoidal sheet configuration in its rotated position with its lateral edges attached to the vane(s) 82 and support beam 62. The pliable web(s) 120 in its neutral position can have a generally gently folded sheet form with a small drape at its front of web 150 and a large drape at its rear of web 152.

The pliable hinge(s) 100 can have a generally cylindrical or elliptical configuration with concave curved sidewalls.

Figure 4B:
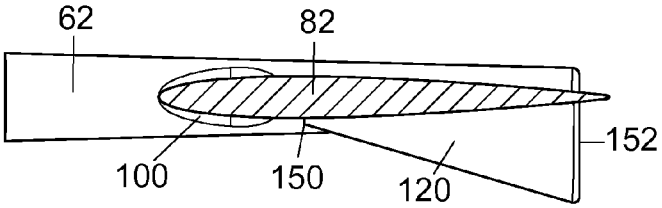

FIG. 4 shows the plan profile and rear views of the pliable hinge 100 and pliable web 120 in a neutral position. The amount of drape of the pliable web 120 can be determined by the amount of pivot to be allowed between the longitudinal axis of the support beam and the longitudinal axis of the vane and its derivation will be described later.

FIG. 5A is a cross-sectional view through the centerline of the pliable hinge 100 and showing how the overmolded pliable material 266 is formed on the beam hinge base 130 and vane hinge base 132 between the beam 62 and the vane 82. The large amount of overmolded pliable material 266 over the connection shaft 128 is what allows the vane 82 to pivot while remaining torsionally biased to the neutral position.

Figure 5C:
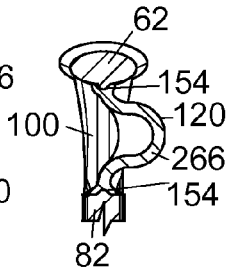
FIG. 5C is a cross-sectional view of FIG. 4A taken at FIG. 5B showing an alternate configuration for the overmolding of the web pliable material.

FIG. 5B shows a cross-sectional view through the pliable web 120 according to the first embodiment. It can be seen that the overmolded pliable material 266 extends through the support beam 62 in the web connection slot 136 and the pliable web 120 is thickened where it covers the web connection rail 138 on the vane 82. FIG. 5C illustrates an additional embodiment of the web connection using only a bump 154 on the vane 82 and support beam 62. This approach is used in the situation where there is sufficient fusion bonding between the pliable and rigid materials that no additional mechanical bonding is necessary. While the embodiments shown herein use separate pliable hinge 100 and pliable web 120 structures this does not preclude the use of a system in which both are merged together as a single unit.

FIGS. 6A, 6B, 6C, and 6D show the pliable hinge 100 and pliable web 120 with the vane 82 pivoted to an optimum angle of attack. It can be seen the pliable web 120 is stretched out essentially flat with allowance for the bends along the fused edges. When the vane 82 is pivoting from its neutral position and has not yet reached the optimum angle of attack the pivoting is resisted only by the pliable hinge 100 but once the optimum angle of attack is reached the pliable web 120 starts to resist the pivoting action and effectively stops it. Testing has revealed the total lifting force on an individual vane is between 4 and 5 pounds.

At the point of optimum angle of attack about half of the lifting force is carried by the pliable hinge 100 and the remainder by the pliable web 120. Since there are two pliable hinges 84, 86 and pliable webs 120, 122 per vane 82 the resultant load to be resisted by the pliable web 120 is about 1 pound along its entire connection bond. As it is not possible for a swimmer to kick more than twice as hard as was determined by testing it is clear there are many pliable materials which can handle the stresses applied in this application without undue distortion. When in the flexed position the pliable web 120 portion serves to reduce the tip vortices in addition to holding the vane 82 at the correct angle of attack. The reduction of tip vortices effectively increases the aspect ratio over the physical aspect ratio. A side benefit of this is the channelizing of the thrust which reduces the turbulence behind the swimmer thus reducing the stirring up of silt when near a silty surface. Any underwater photographer can explain the importance of keeping the water as free of silt as possible. Stirred up silt reduces visibility in the water, sometimes to the point of totally obscuring one's path. Stirred up silt has been the root cause of the death of many scuba divers.

Figure 7C:
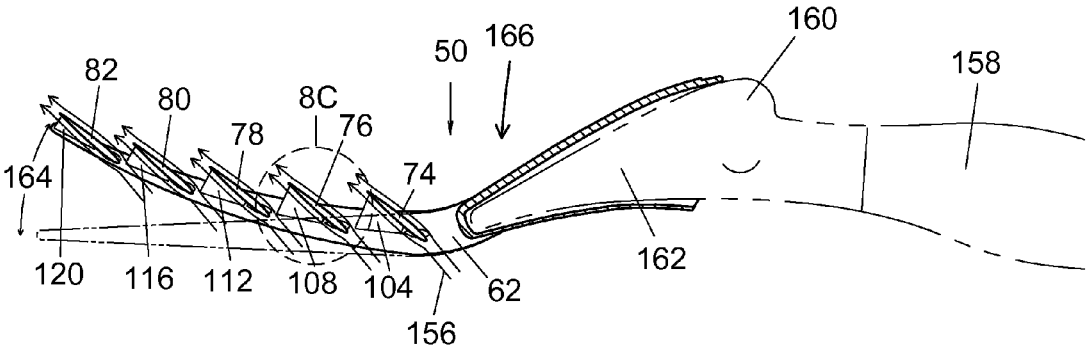

FIGS. 7A, 7B and 7C show the combined function of the support beams 62, 64 and vanes during a typical swimming stroke for the first embodiment of the novel fin 50 used with the leg 158, heel, and foot 162 and the direction of foot motion 166. For the purposes of this discussion up will be taken as toward the top of the page or toward the heel 160 of the swimmer since most swimming occurs with the swimmer's face down. FIG. 7A shows a typical up stroke using the invention, FIG. 7B shows a neutral or coasting position where no upward or downward force is being applied yet the swimmer is still moving forward, and FIG. 7C shows a typical downward stroke.

Figure 8A:
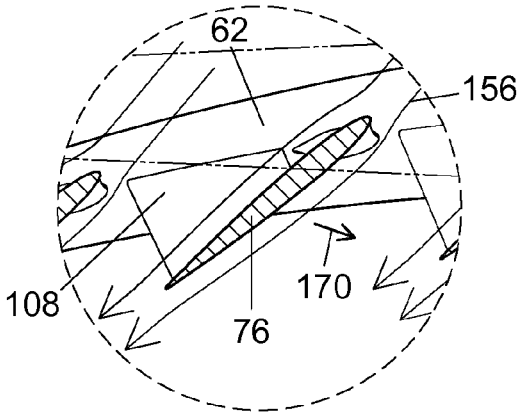
FIGS. 8A, 8B, and 8C show the flow around individual vanes from FIGS. 7A-7C.
Figure 8B:
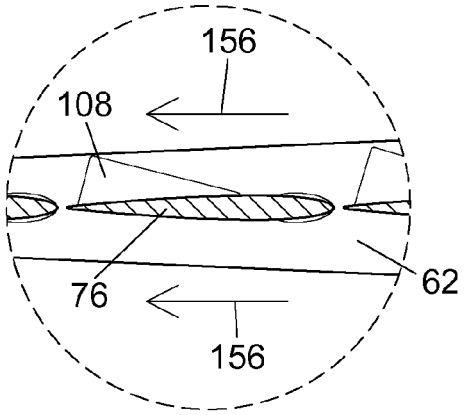

In the neutral position shown in FIG. 7B all of the vanes are aligned with the support beam thus minimizing the overall drag created by the swim fin 50. There is virtually no interaction between the flow 156 and the vanes 74-82 as shown in FIG. 8B. During the upstroke in FIG. 7A the foot travels in an upward and forward direction 166 relative to the water. The vanes deflect to an optimum angle of attack with the flow It has been found that this optimum angle of attack to the flow for a NACA 0009 airfoil is approximately 4 degrees. To account for the dynamics of swimming it was necessary to determine the optimum angle of attack relative to the longitudinal axis of the support beams by physical testing which resulted in an angle of about 40 degrees on a swim fin with a fixed downward support beam deflection 168 of 30 degrees.

Support beam flexibility is an important consideration in this invention. If the beam supports 62, 64 are too stiff there is undue ankle stress. If the beam supports 62, 64 are too flexible the vanes 74-82 when aligned at optimum angle of attack will not have sufficient offset to be efficient. It is known that as airfoils get closer together the efficiency of the pair decreases.

Also it is known that staggering the upper airfoil forward of the lower one improves the efficiency of the pair. This invention provides for a substantial forward stagger of the vanes 74-82 and, with rigid support beams, has a reasonable vertical spacing of vanes 74-82. Rigid support beams contribute to ankle stress so it is necessary to use semi-flexible support beams 62, 64 with a maximum flexure 164 of no more than 30 degrees. For the purpose of the illustrations the first embodiment shows a beam maximum flexure 164 of 30 degrees which is greater than should be used in practice.

Figure 4C:
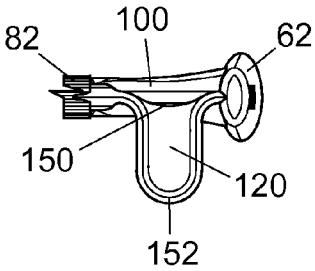
Figure 6A:
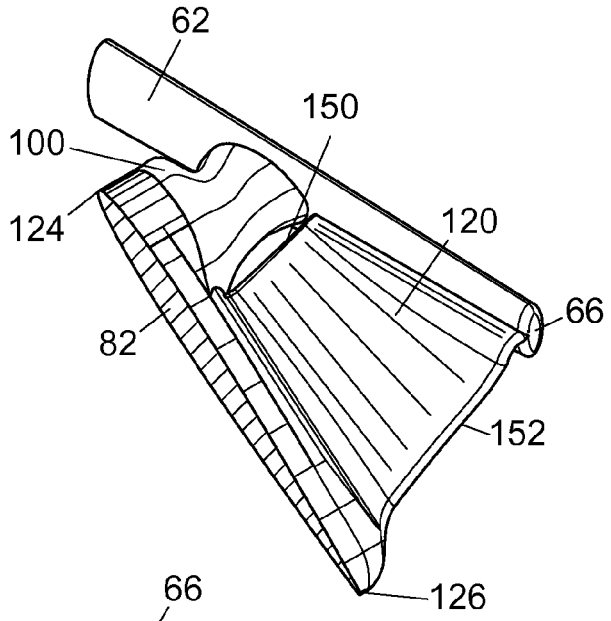
FIGS. 6A, 6B, 6C and 6D are isometric, plan, profile and side views of the novel support beam and vane interconnection of the preceding figures in a rotated position.
Figure 6B:
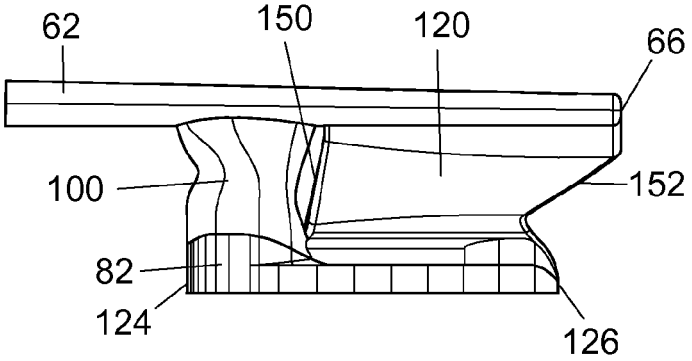
Figure 6C:
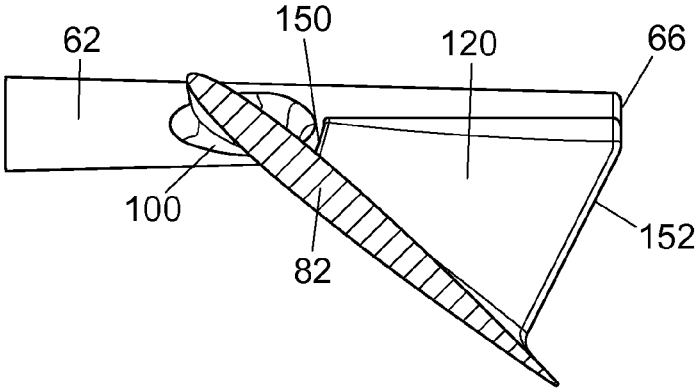
Figure 6D:
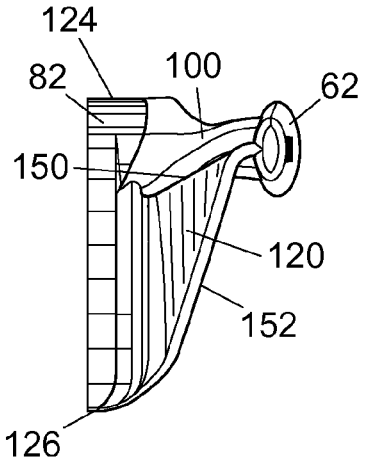

Given the flexing of the support beam, it is necessary to set the optimum angle of attack for each vane 74-82 so it will be proper with the support beam 62 is in the flexed position as shown in FIG. 7A or FIG. 7C. It can be seen that while each vane 74-82 is set at a different angle to the support beam 62 they all are parallel to each other. This is accomplished by setting the drape of the web for each vane using common geometrical relationships as follows. First the optimum angle of attack is determined by experimental processes. Then the normal flexure of the support beam 62 is determined. Next, based on the location of each vane along the support beam determine the local support beam 62 flexure angle at each vane 74-82 location. The optimum angle of attack less the local support beam flexure angle is the individual vane rotation angle to be set as shown in FIG. 6C. The length of the web from the longitudinal axis of the support beam to the center plane of the rotated vane is then determined for the front of the web and the rear of the web accounting for the limits of curvature of the pliable material along the edges. Next calculate the amount of drape required to fit the pivoted web distance into the non pivoted geometry as illustrated in FIGS. 4C and 5B.

Figure 8C:
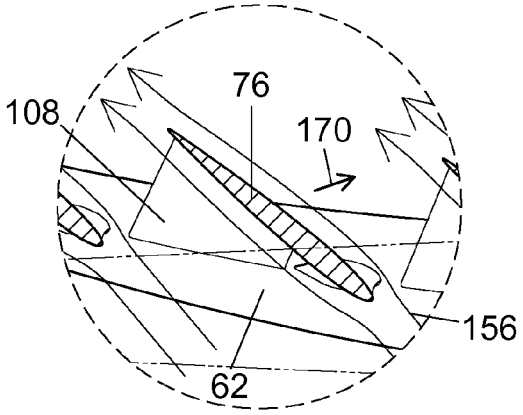

FIG. 7A shows that all vanes 74-82 are optimally aligned with the flow 156 since they are each aligned appropriately to the support beam 62 in the flexed position. Because there is a small angle of attack between the flow 156 and the vanes 74-82 then hydrodynamic lift 170 is generated generally in the direction of travel of the swimmer as shown in FIGS. 8A, and 8C. FIG. 7C shows the flow 156 for the downstroke, and it can be seen that the beam deflection angle 168 combined with the support beam flexure angle 164 and properly proportioned pliable webs 104, 108, 112, 116, 120 serves to allow the optimum angle of attack on the downstroke also.

Second Embodiment

Figure 9A:
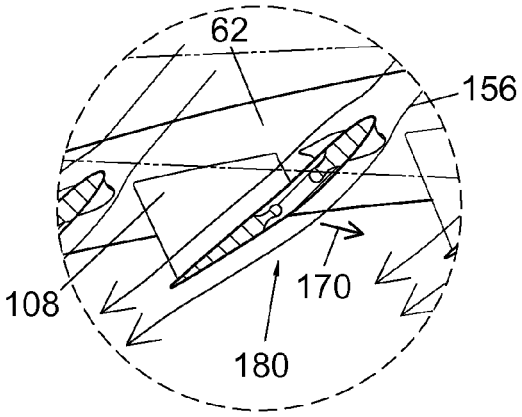
FIGS. 9A, 9B and 9C show the flow around individual vanes from FIG. 10A-10C.
Figure 9B:
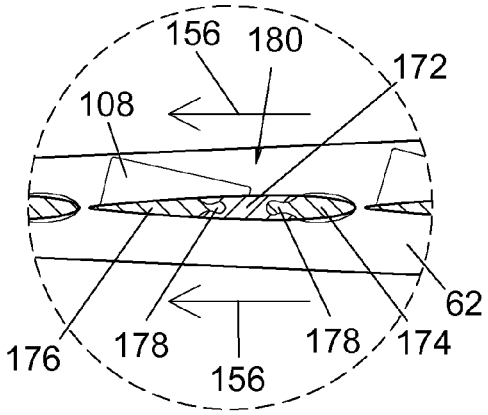
Figure 9C:
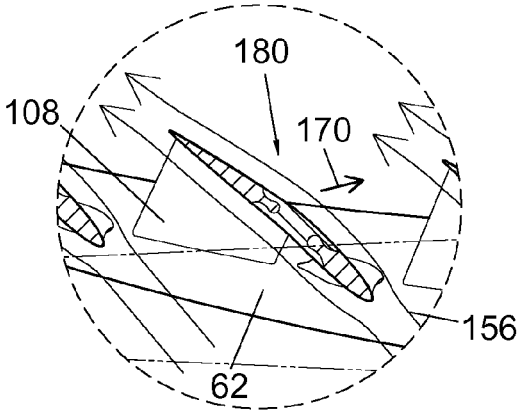
Figure 10C:
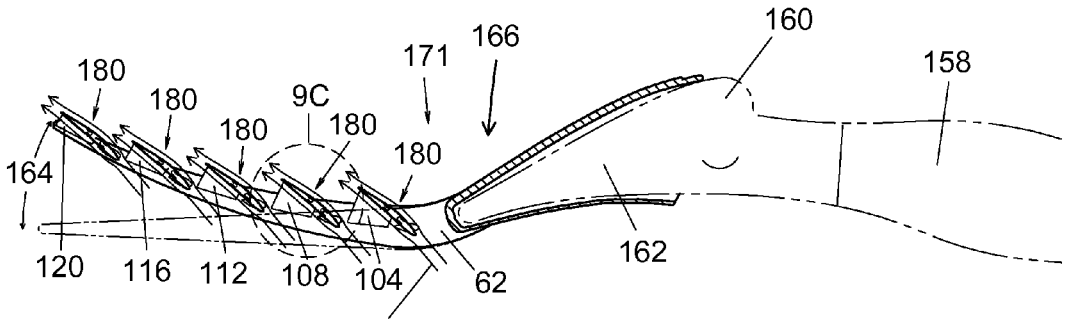

FIGS. 10A, 10B and 10C show the operational sequence of another embodiment of the invention using symmetrical laterally flexible vanes 180 in the fixed support beam fin 171 used with the leg 158, heel, and foot 162 and the direction of foot motion 166. FIGS. 9A, 9B and 9C show the flow 156 around individual vanes from FIG. 10A-10C. The second embodiment is similar to the first except the vanes 180 are flexible along their lateral axes at about the 40% chord distance. The flexible connector 172 is a pliable material overmolded onto a rigid leading edge 174 and rigid trailing edge 176 as illustrated in FIG. 9B. To facilitate a stronger bond between the two materials a rail system 178 similar to the web connection rail 138 of FIG. 2C. The function of the swim fin in this embodiment is substantially similar to the function of the first embodiment except the flexure of the vanes 180 effectively creates a reversibly asymmetric hydrofoil with a higher lift to drag ratio than in the first embodiment.

FIGS. 10A, 10B, 10C illustrate the stroke dynamics which is similar to that of the first embodiment with the exception of the additional curvature of the laterally flexible vane 180 which according to computational fluid dynamic calculations improves the lift to drag ratio by 290% over that of the symmetrical rigid vane.

Figure 13:
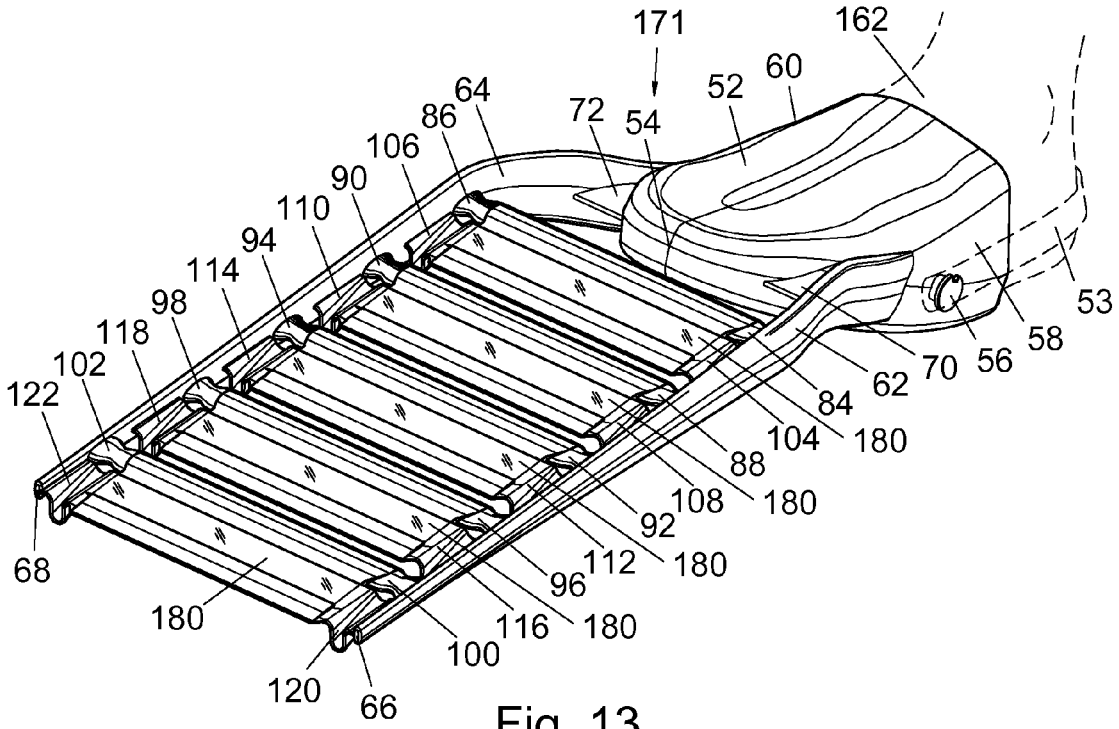
FIG. 13 is an isometric view of an alternate embodiment of the swim fin with laterally flexible vanes.

FIG. 13 shows an isometric view of the second embodiment of the invention in a neutral state. This is similar to the first embodiment except for the laterally flexible vanes 180 which improve the overall lift drag ratio. The laterally flexible vane operation is shown and described in reference to FIGS. 9A-10C.

Third Embodiment

Figure 11:
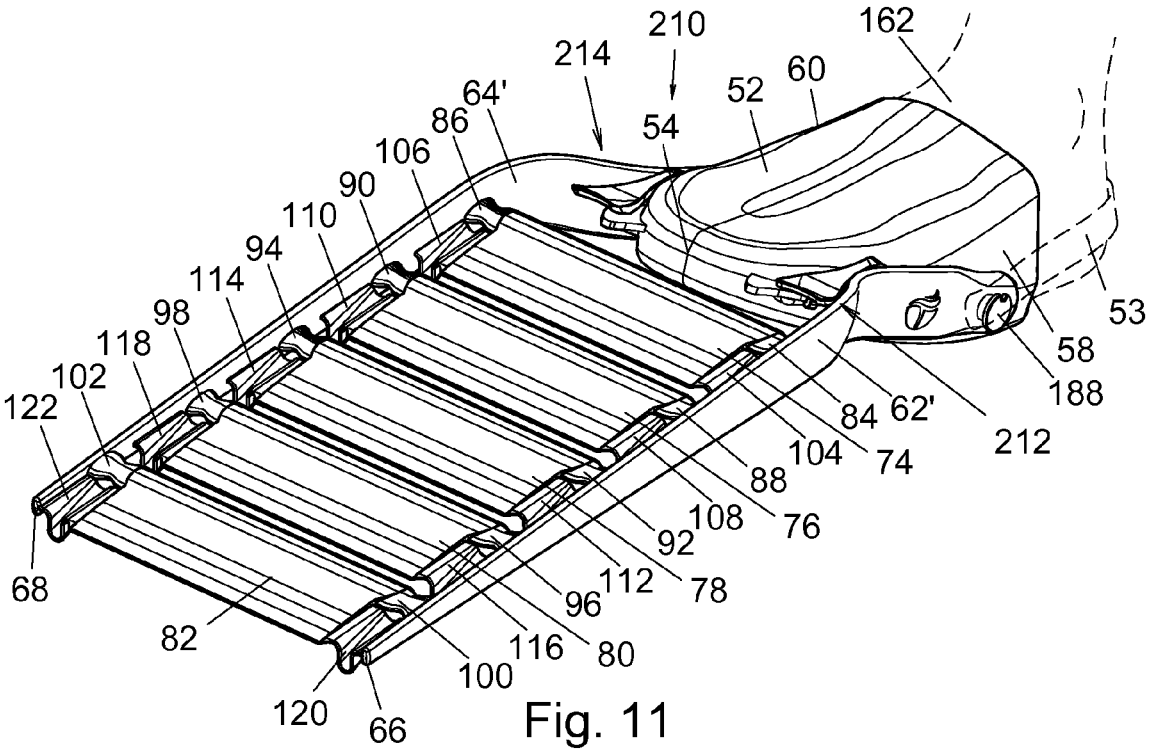
FIG. 11 is an isometric view of an alternate embodiment of the swim fin with pivotally attached support beams in the operating latched position.

FIG. 11 shows a third embodiment 210 which is similar to the first embodiment with the entire support beam and vane structure being pivotally attached to the foot pocket 52 and secured by dual latch assemblies 212, 214 on the sides of the foot pocket 52. The latch assemblies 212, 214 are detailed in FIGS. 16-20B.

Figure 12:
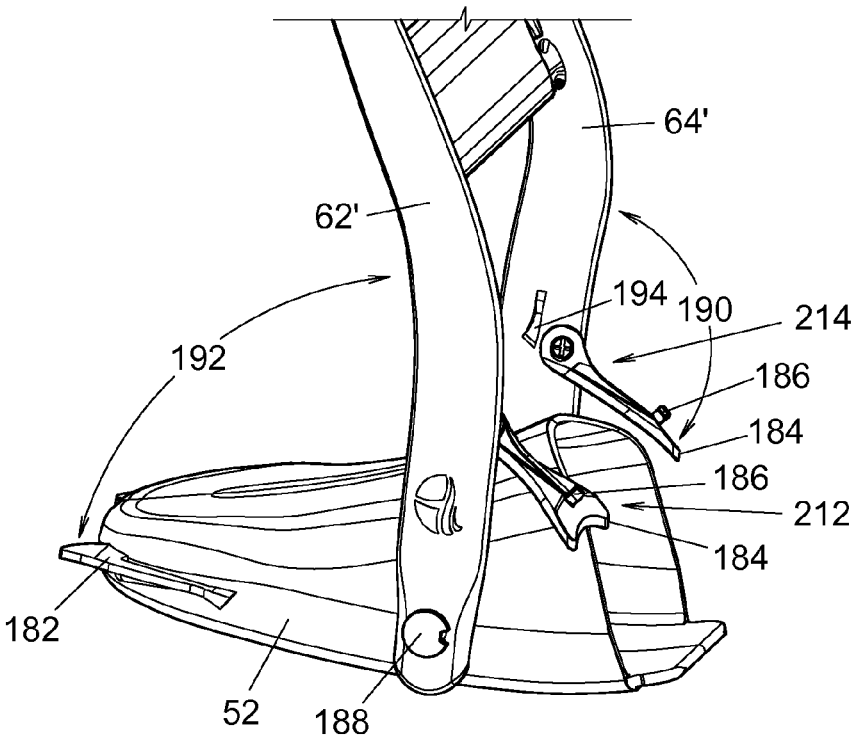
FIG. 12 is an isometric view of an alternate embodiment of the swim fin with pivotally attached support beams in the un-latched and rotated walking position.

FIG. 12 shows the third embodiment in its pivoted up position. In this position it is possible for the swimmer to walk on land or a boat without stumbling over the large propulsion surface in front of him. Pivotally attached propulsion surfaces for swim fins exist in the public domain. U.S. Pat. No. 4,981,454 by Klein, which is incorporated by reference is an example which uses a toe located latch.

The latching mechanism of the third embodiment operates through a captive ledge system much like the dead bolt on a door. The difference is that in this case the deadbolt is fixed and the pocket it slides into is movable. The support beams 62', 64' are pivotally attached to the foot strap pegs 56 (FIG. 1) on the foot pocket 52.

Referring to FIGS. 11-16 duplicate replacement foot strap pegs 188 are attached to the outside of the support beams 62', 64' to replace the foot strap pegs 56 (FIG. 1) used by attaching the support beams 62', 64'. When rotated to the closed position as in FIG. 11 the support beams 62', 64' being elliptical in cross section collide with the latch ledge 182 which forces the support beams 62', 64' to separate sufficiently to slide over the latch ledges 182 until the latch slot 194 (shown in FIGS. 12 and 16) in the support beams 62', 64' align with the latch ledges 182. At this point the support beams 62', 64' snap back into their original alignment captivating the latch ledge 182 and preventing the support beams 62', 64' from further movement. At this point the cam lever 184 is secured by slipping the cam lock clip 186 over the latch ledge 182. The support rails are then held in position by the stiffness of the support beams 62', 64' which are held in position by the foot strap pegs 56 and vanes 74-82 which are fused to the support beams 62', 64' through the pliable hinges 84-102. The process for unlatching the latch ledge 182 is described in reference to FIGS. 18A-20B.

The cam lever 184 rotation is shown by arrow 190, and the support beam(s) 62', 64' rotation 192 is shown in FIG. 12.

Fourth Embodiment

Figure 14:
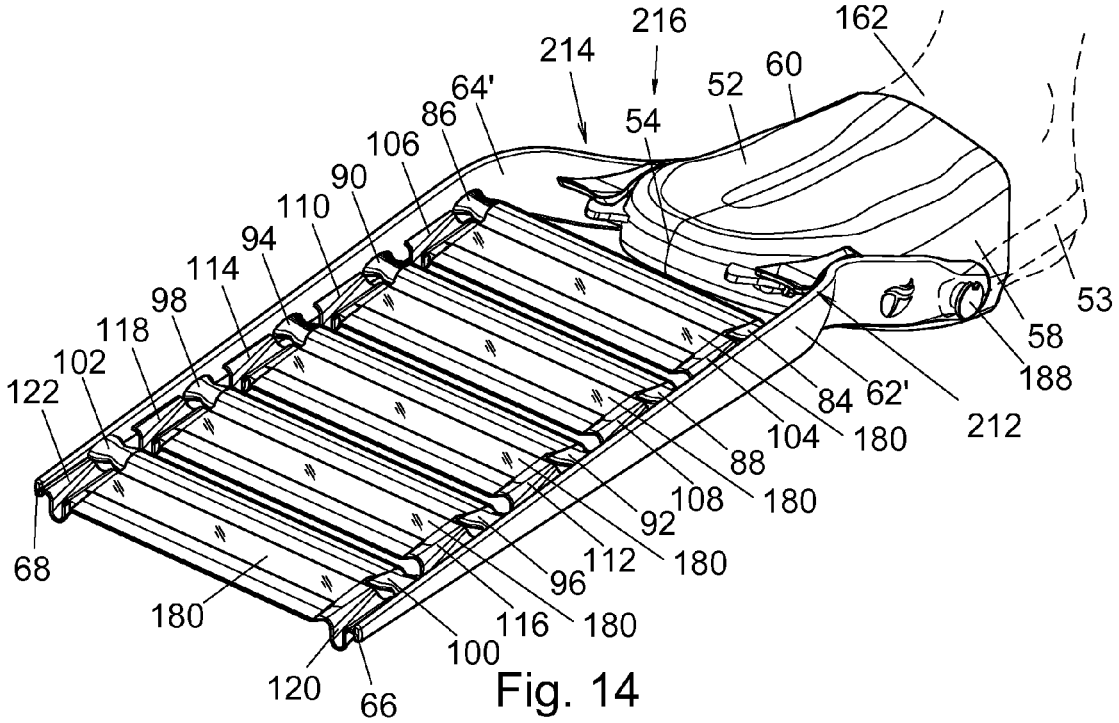
FIG. 14 is an isometric view of an alternate embodiment of the swim fin with laterally flexible vanes and pivotally attached support beams in the operating latched position.

FIG. 14 illustrates isometric view of the fourth embodiment 216 of my invention in its neutral state. This is similar to the third embodiment except for the laterally flexible vanes 180 which improve the overall lift drag ratio. The laterally flexible vane operation is described in reference to FIGS. 9A-10C.

Figure 15:
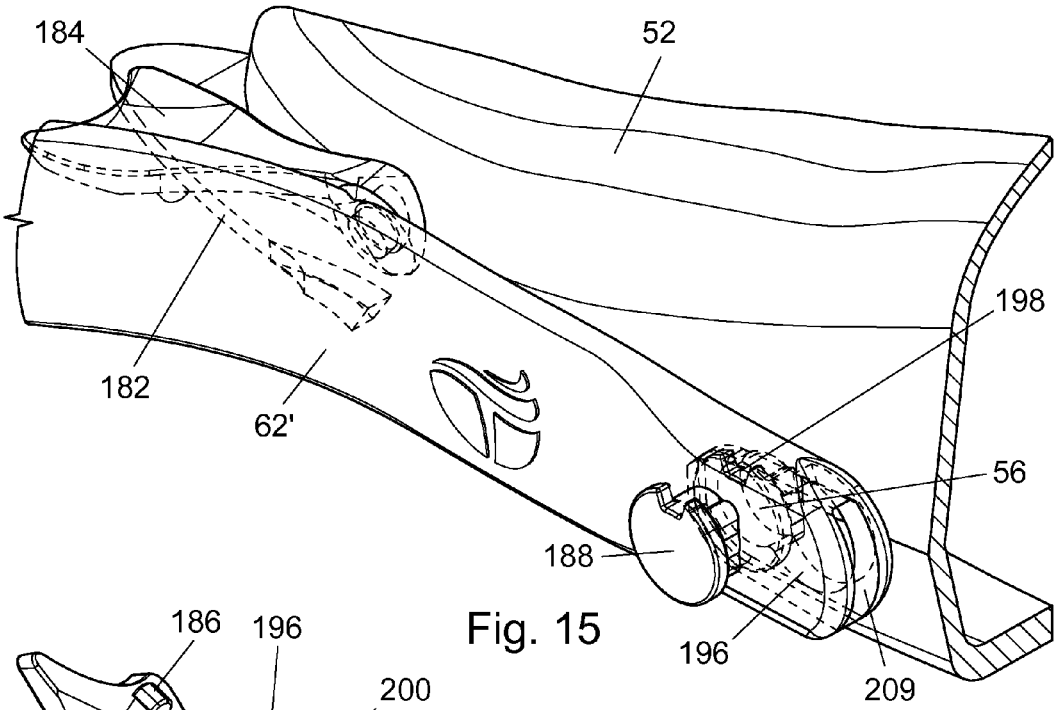
FIG. 15 is an isometric view of a latching system for the pivotally attached support beam embodiment with the cam lever in the latched position.

FIG. 15 shows the latched position of one latching application for embodiments three and four. The support beam 62' can be pivotally attached at the receptacle 196 for the foot strap peg 56 to the foot pocket 52 at the foot strap peg 56. The geometry of the foot strap receptacle 196 is shown more clearly in FIG. 16. Since the foot strap peg 56 on the foot pocket is covered by the support beam 62' the support beam 62' has a replacement foot strap peg 188 to serve the purpose of the original foot strap peg 56. The support beam 62' can be attached to the foot pocket 52 by aligning the tab 200 on the foot strap receptacle 196 with the keyway 198 of the foot strap peg 56 and sliding it on. Once the foot strap peg 56 is inserted into the foot strap receptacle 196 on the support beam 62' the support beam 62' is slid laterally on the foot strap peg 56 until the foot strap peg 56 is aligned with the replacement foot strap peg 188 at which point the support beam is in its operating position and may be rotated to a horizontal latched position as described with FIG. 12.

The cam lever 184 is a beveled rotating cam which in the latched position lies between the support beam 62' and the foot pocket 52 without exerting any influence on either.

Figure 16:
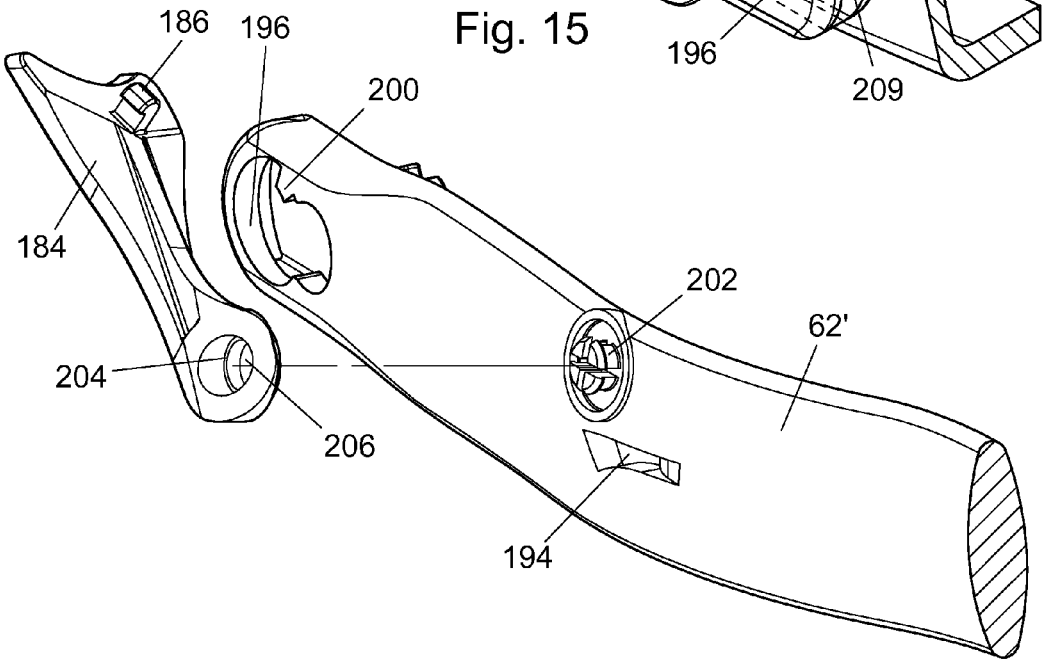
FIG. 16 is an exploded isometric view of a latching system for the pivotally attached support beam embodiment with the cam lever in the un-latched position.

FIG. 16 is a view of the support beam 62' and cam lever 184 separated to show the underlying cam lever post 202 and a clearer view of the latch ledge slot 194 and foot strap peg receptacle 196. The latch ledge slot 194 in the support beam 62' which accepts the latch ledge 182 on the foot pocket 52 is shaped to match the shape of the latch ledge 182. The particular shape of the slot 194 and the latching ledge 182 in this embodiment is based on an existing foot pocket 52 with a latch ledge 182 of this geometry. Other shapes of the latching ledge 182 would also suit this purpose and can have additional benefits. Of key importance to this invention is the top and bottom surfaces of both the latch ledge 182 and slot 194 need to be nearly parallel and near perpendicular to the axis of the shear force created at the interface of the two features when the swim fin is in active use. The latch ledge 182 must be sufficiently strong to resist the shear forces created. This is estimated at about 40 pounds per support beam 62' perpendicular to the longitudinal axis of the support beam 62'. Depending on the spacing between the latch ledge 182 and the foot strap peg 56 the actual shear force can vary substantially.

The cam lever 184 has three primary design features which will be described more thoroughly in reference to FIGS. 17-20B. In embodiments three and four the cam lever 184 can be pivotally attached to the support beam 62' by a press fit over a cam lever post 202 which is molded into the support beam 62'. Since this is a plastic material the lever post 202 is somewhat flexible so press fitting the cam lever 184 over the lever post 202 will cause the pegs to deflect somewhat then snap back to their original shape after the shoulder 204 in the cam pivot hole 206 has been reached. FIG. 18A shows the cam lever 184 in its installed condition. This example of cam lever 184 connection does not preclude other attachment methods such as a simple screw and washer.

The foot strap peg receptacle 196 is also shown in FIG. 16 showing the tab 200 to be aligned with the keyway 198 on the foot strap peg 56 before the foot strap peg 56 is inserted into the receptacle 196 and slid forward to its operational position. The opening 209 in the back of the support beam 62' at the receptacle 194 is simply for the purpose of making the device injection moldable.

FIG. 17 shows the cam lever 184 in a locked position as viewed from directly above. The broad upper surface 207 of the cam lever serves to channelize or normalize the flow between the foot pocket 52 and support beam 62'. The locking clip 186 is shown engaged over the edge of the latch ledge 182 to prevent the cam lever 184 from moving when the swim fin is in use. It can be seen the latch ledge 182 is well seated in the latch ledge slot 194 in this configuration preventing the support beam from rotating out of this position.

Figure 19A:
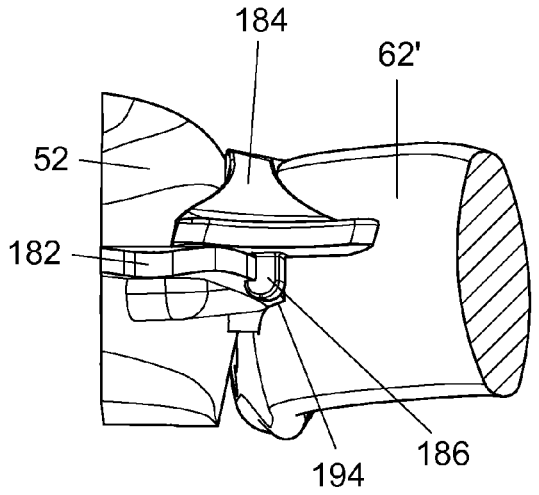
FIG. 19A is an end view of the latching system for the pivotally attached support beam embodiment shown in FIG. 17 with the cam lever in the latched position.
Figure 19B:
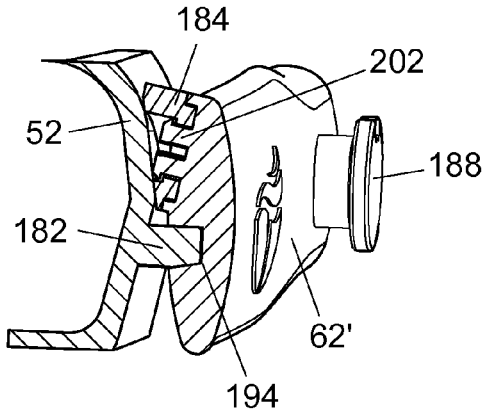
FIG. 19B is a section view as shown in FIG. 17 of a latching system for the pivotally attached support beam embodiment with the cam lever in the latched position.

FIG. 19A is a view of FIG. 17 from the front showing the cam lever 184 in the locked position. Notice the lock clip 186 has captured the edge of the latch ledge 182 and the latch ledge 182 is securely seated in the latch slot 194. FIG. 19B is a cross-sectional view of FIG. 17 through the axis of the cam latch post 202 clearly showing the tapered nature of the cam and how it fits between the support beam 62' and foot pocket 52 without exerting any force on either. Also shown in FIG. 17 is the foot strap peg 56 seated in the foot strap peg strap receptacle 196 pivotally fixing the end of the support beam 62'. Molded to the side of the support beam 62' is the replacement foot strap peg 188 which is used to fasten the commonly available foot strap 53.

FIGS. 18A and 18B show a view from above illustrating the effect of rotating the cam lever 184 up. This upward rotation pushes the support beam 62' away from the foot pocket 52 releasing the latch ledge 182 from the ledge slot creating a gap 208 as shown in FIG. 18B, thus allowing the support beam 62' to rotate freely upward as illustrated in FIG. 12.

Figure 20A:
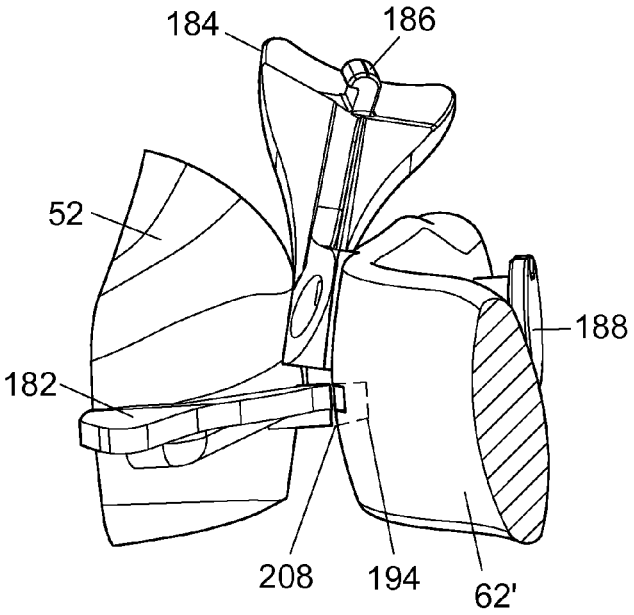
FIG. 20A is an end view of the latching system for the pivotally attached support beam embodiment shown in FIGS. 18A-18B with the cam lever in the un-latched position.
Figure 20B:
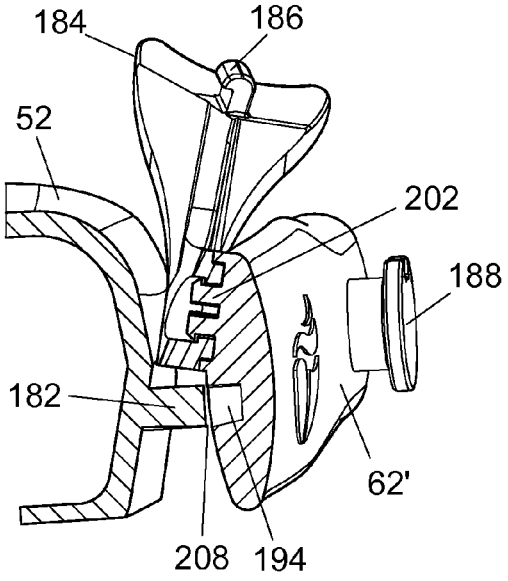
FIG. 20B is a cross-section view as shown in FIGS. 18A-18B of a latching system for the pivotally attached support beam embodiment with the cam lever in the un-latched position.

FIG. 20A shows how the thicker portion of the cam 184 is pressed against the side of the foot pocket 52 increasing the gap 208 between foot pocket 52 and the support beam 62'. FIG. 20B is a cross-sectional view through the axis of the cam latch 184 clearly showing the thicker portion of the cam and how it presses against the foot pocket 52 forcing the support beam 62 and foot pocket 52 apart and consequently removing the latch ledge 182 from the latch slot.

Fifth Embodiment

FIG. 21A shows a fifth embodiment, a symmetric planar curved vane pivotally attached support beam swim fin 218, which is similar to the third embodiment described above, with the entire support beam and vane structure being pivotally attached to the foot pocket 52 at left and right hinge points 220 and 222. The left and right elongated support beams 224 and 226 are connected and stabilized by cross beam 228 and can be secured by a single lock mechanism, such as component 80 shown and described in reference to FIG. 9 of U.S. Pat. No. 7,462,085 B2 to Moyal, which is incorporated by reference. FIG. 22 referenced below shows additional detail of the locking mechanism that can be used in the invention.

Figure 21:
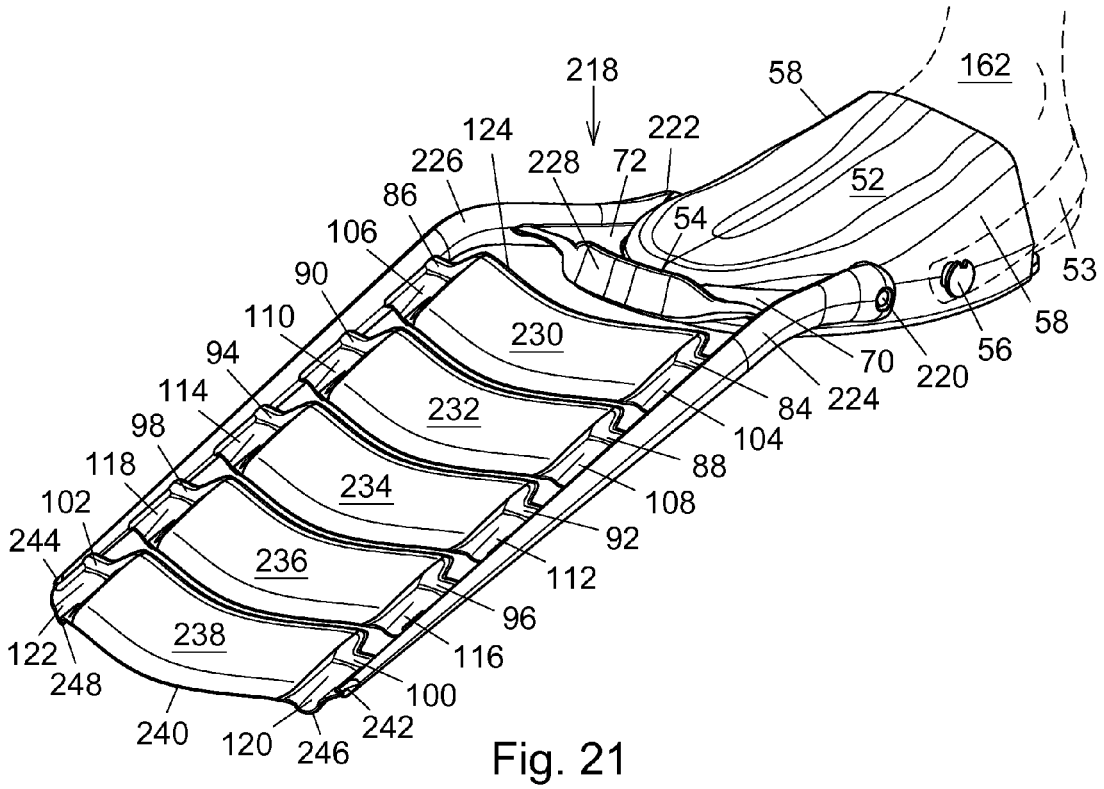
FIG. 21 is an isometric view of an alternate embodiment of the swim fin with planar, curved vanes and convex curved end webs.
Figure 22:
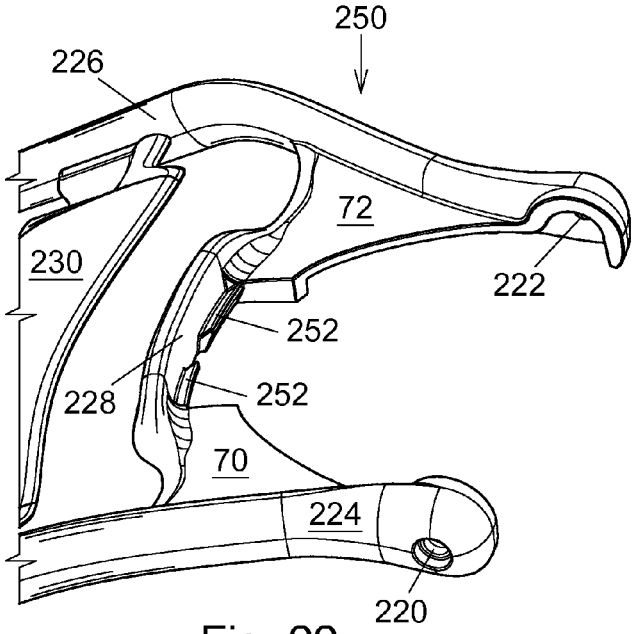
FIG. 22 is an oblique view of a cross beam of FIG. 21 with its lock receptacle.

Referring to FIG. 21, planar curved vanes 230, 232, 234, 236, and 238, which are defined more thoroughly in FIG. 24A below, can be used in this embodiment. The elongated support beams 224 and 226 can be terminated before reaching the trailing edge 240 of planar curved vane 238 with left and right tapered end portions 242 and 244 respectively. Pliable webs 120 and 122 can have convex curved trailing edges 246 and 248 which reduce the likelihood of the pliable webs 120 and 122 snagging on external objects. The tapered end portions 242 and 244 and convex curved trailing edges 246 and 248 are further shown in FIGS. 26A-26E.

A benefit of the planar curved vane 230 is the increased clearance between the toe portion 54 of the foot pocket 52 and the leading edge 124 of the first vane which will allow less turbulent flow over the first planar curved vane 230 resulting in better overall lift to drag ratio.

FIG. 22 shows another view of a propulsion assembly 250 of the fifth embodiment which reveals the lock receptacles 252 attached to the cross beam 228. The lock receptacles are shaped to match the shape of the lock mechanism such as the component 80 referenced in FIG. 9 of U.S. Pat. No. 7,462,085 B2 to Moyal, described above, which is incorporated by reference. While this is an example of one method of latching the propulsion assembly 250 in its operational position this embodiment is not limited to only this configuration.

Figure 23A:
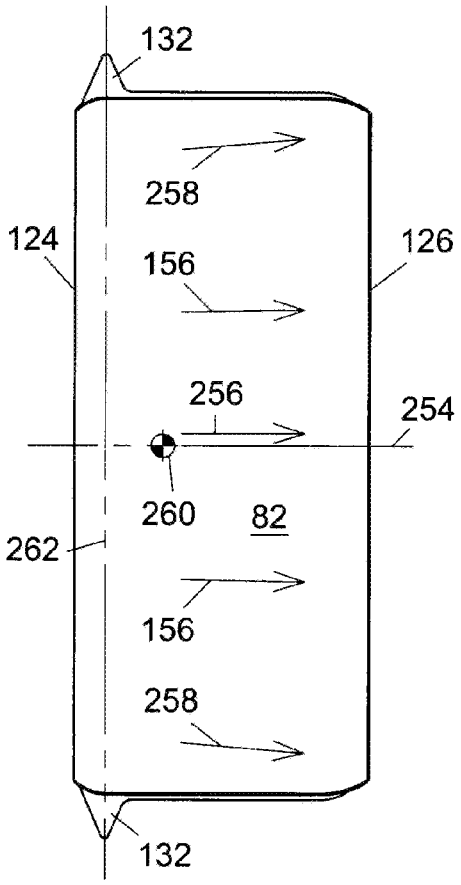
FIG. 23A illustrates hydrodynamic flow over a straight vane.

FIG. 23A illustrates the hydrodynamic flow 156 over a straight vane 82. Centerline flow 254 over an unconstrained straight vane 82 follows the longitudinal axis 256, but outward edge flow 258 tends to flow away from the longitudinal axis 256. This contributes to tip vortices and reduction in overall lifting efficiency of the vane. Pliable webs 104-122 as shown in other figures decrease the effect of vortices. The location of the center of lift 260 makes it is necessary to have the axis of rotation 262 near the leading edge 124 to create sufficient moment to rotate the vane 82 into its optimum operating position.

Figure 23B:
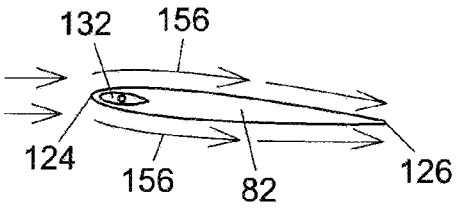
FIG. 23B illustrates the profile of hydrodynamic flow on the vane of FIG. 23A.

FIG. 23B illustrates the profile of hydrodynamic flow 156 over the straight vane 82. Also shown is a forward location of the vane hinge base 132 which restricts its thickness and ultimate strength.

Figure 24A:
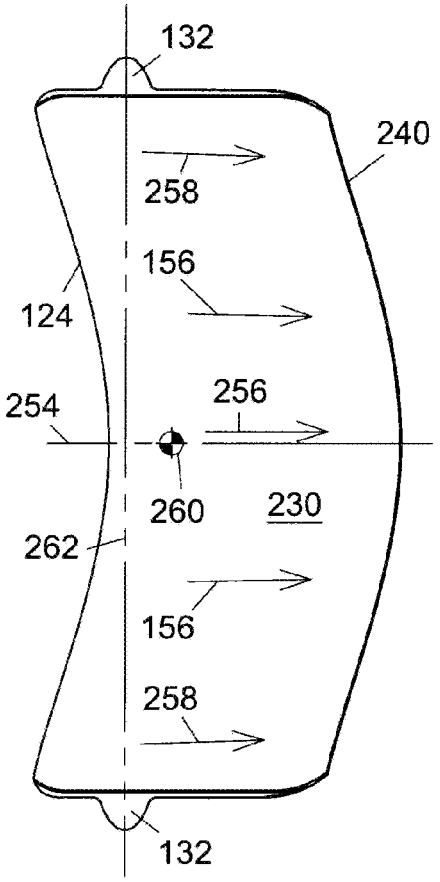
FIG. 24A illustrates the hydrodynamic flow over a typical planar curved vane.

FIG. 24A illustrates the hydrodynamic flow 156 over a planar curved vane 230. A planar curved vane 230 is a vane in which the projection of the leading edge of the vane onto a plane defined by the axis of rotation 262 and a point on the trailing edge 240, of the vane defines a curve wherein the leading edge 124 of the central portion of the vane is behind a leading edge 124 at the lateral edges of the vane.

Centerline flow 254 over an unconstrained planar curved vane 230 follows the longitudinal axis 256. The outward edge flow 258 tends to flow slightly toward the longitudinal axis 256. This reduces tip vortices and improves the overall lifting efficiency of the vane. Pliable webs 104-122 as shown in other FIGS. 1, 11, 13, 14, and 21 also decrease the effect of vortices. Testing has shown this configuration allows the swimmer to use approximately 10% less air to travel the same distance and speed than with straight vanes. The more aft location of the center of lift 260 makes it possible to locate the axis of rotation 262 further aft from the leading edge 124 where the planar curved vane 230 is thicker allowing for a stronger vane hinge base 132 while still creating sufficient moment to rotate the vane 82 into its optimum operating position.

Figure 24B:
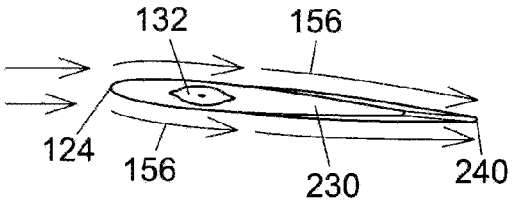
FIG. 24B illustrates the profile of hydrodynamic flow over the vane of FIG. 24A.

FIG. 24B illustrates the profile of hydrodynamic flow 156 over the planar curved vane 230. Also shown is a more centralized location of the vane hinge base 132 which allows maximum thickness and a higher ultimate strength.

Figure 25A:
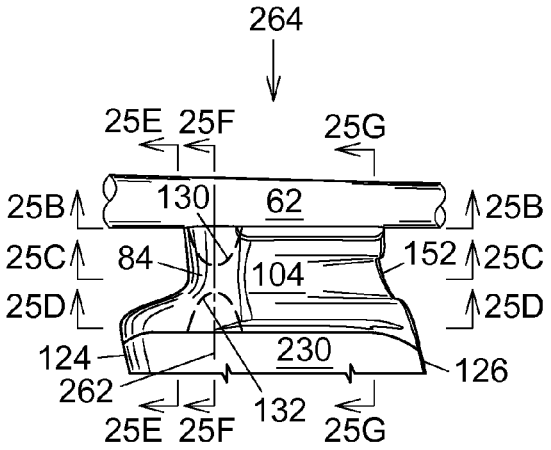
FIG. 25A illustrates the plan view of a pliable hinge-web assembly.

FIG. 25A illustrates the plan view of a pliable hinge-web assembly 264 consisting of the pliable hinge 84 and pliable web 104 fused to the support rail 62 and planar curved vane 230 as could be used with the fifth embodiment or any other embodiment with a more centrally located pliable hinge 84 location. The pliable hinge 84 and pliable web 104 are joined in this embodiment which allows less flow disturbance and increases the torsional resistance to the planar curved vane 230 which increases the portion of the stroke where useful lift is being generated.

The method of attachment between the pliable hinge 84, pliable web 104 and support beam 62 and planar curved vane 230 is similar to the method illustrated in FIG. 5C above. The pliable hinge 84 can be constructed using an injection molding process, called overmolding, where a pliable material is formed over the beam hinge base 130 and vane hinge base 132 causing the pliable material to fuse to the rigid material of the beam hinge base 130 and vane hinge base 132 resulting in a pliable hinge 84.

The alignment is defined by the alignment of the beam hinge base 130 and vane hinge base 132 and the amount of resistance to angular rotation is controlled by the thickness and durometer of the pliable material. It is important to note this pliable hinge 84 arrangement does not include any central shaft whatsoever. The planar curved vane 230 is then free to rotate along axis of rotation 262 relative to the support beam 62 with the rotational effort being resisted by the pliable hinge 84 and the maximum rotation angle is limited by the pliable web 104. The functional effect is similar to that illustrated in FIGS. 6A-6D.

Figures 25E, 25F, 25G:
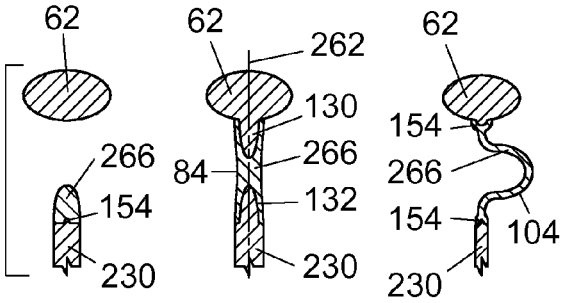
FIG. 25E is a partial cross-sectional view of the pliable hinge-web assembly along arrows 25E of FIG. 25A.
FIG. 25F is a cross-sectional view of the pliable hinge-web assembly along arrows 25F of FIG. 25A.
FIG. 25G is a partial cross-sectional view of the pliable hinge-web assembly along arrows 25G of FIG. 25A.
Figure 25B:
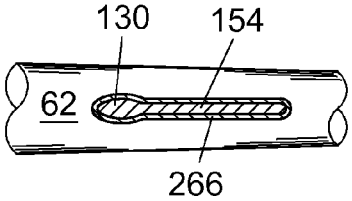
FIG. 25B is a cross-sectional view of the pliable hinge-web assembly along arrows 25B of FIG. 25A.

FIG. 25B is a cross-sectional view of the pliable hinge-web assembly 264 at the pliable web 104, support beam 62 interface along arrows 25B in FIG. 25A. The beam hinge base 130 and connection bump 154 is shown as covered with an overmolded pliable material 266.

Figure 25C:
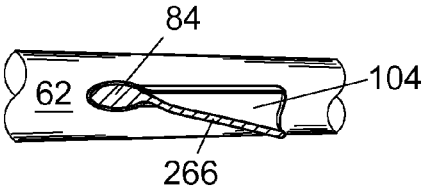
FIG. 25C is a cross-sectional view of the pliable hinge-web assembly 264 along arrows 25C of FIG. 25A.

FIG. 25C is a cross-sectional view of the pliable hinge-web assembly 264 at the centerline of the pliable web 104 along arrows 25C in FIG. 25A. The pliable hinge 84 and pliable web 104 are shown as flowing into each other and made from overmolded pliable material 266.

Figure 25D:
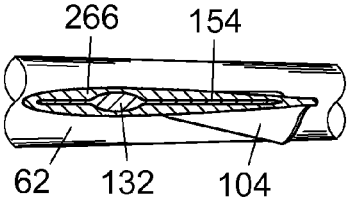
FIG. 25D is a cross-sectional view of the pliable hinge-web assembly along arrows 25D of FIG. 25A.

FIG. 25D is a cross-sectional view of the pliable hinge-web assembly 264 at the pliable web 104, planar curved vane 230 interface along arrows 25D in FIG. 25A. The vane hinge base 132 and connection bump 154 is shown as covered with overmolded pliable material 266.

FIG. 25E is a partial cross-sectional view of the pliable hinge-web assembly 264 just ahead of the pliable hinge 84 along arrows 25E in FIG. 25A. The connection bump 154 is shown on the planar curved vane 230 as covered with overmolded pliable material 266.

FIG. 25F is a partial cross-sectional view of the pliable hinge-web assembly 264 at the axis of rotation 262 along arrows 25F in FIG. 25A. The beam hinge base 130 attached to the support beam 62 and the vane hinge base 132 attached to the planar curved vane 230 are covered with overmolded pliable material 266 to form the pliable hinge 84 which allows rotation of the planar curved vane 230 in relation to the support beam 62 along the axis of rotation 262. The location of the beam hinge base 130 and the vane hinge base 132 at the thickest part of the planar curved vane 230 allows maximum thickness and strength of the beam hinge base 130 and the vane hinge base 132.

FIG. 25G is a partial cross-sectional view of the pliable hinge-web assembly 264 just ahead of the rear of web 152 along arrows 25G in FIG. 25A. The pliable web 104 can be made of overmolded pliable material 266 and covers and is fused to connection bumps 154 the support beam 62 and on the planar curved vane 230. The method of calculation of the amount of drape in the pliable web 104 is described in the description of FIGS. 7A-7C.

Figure 26A:
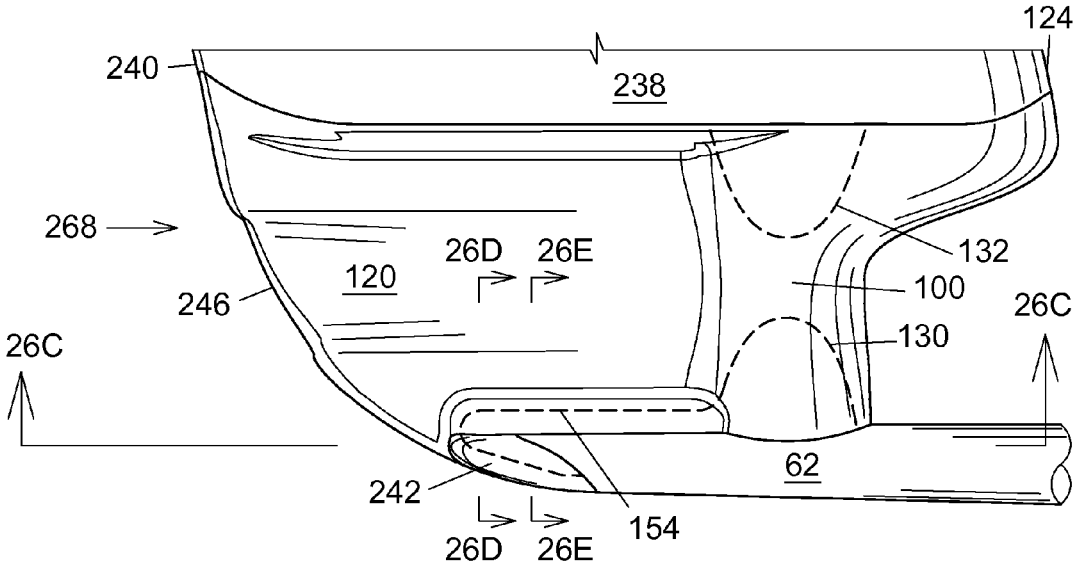
FIG. 26A is a plan view of a trailing edge hinge-web assembly of FIG. 21.

FIG. 26A illustrates the plan view of a trailing edge hinge-web assembly 268 as it could be applied to the fifth embodiment. The construction of this assembly is similar to that described for FIGS. 25A-25G. To reduce the probability of ensnarement on external objects the support beam 62 can be terminated ahead of the trailing edge 240 and the pliable web 120 can be clipped with a convex curved trailing edge 246. It has been found that hard rubbers tend to wear better than hard plastics in the marine environment.

To reduce the stresses on the pliable web 120 and provide a wear surface the support beam 62 can be capped with a tapered end portion 242 made of the same pliable material 266 as the pliable web 120 and can be supported internally by an extension of the connection bump 154 which is formed on support beam 62.

Figure 26B:
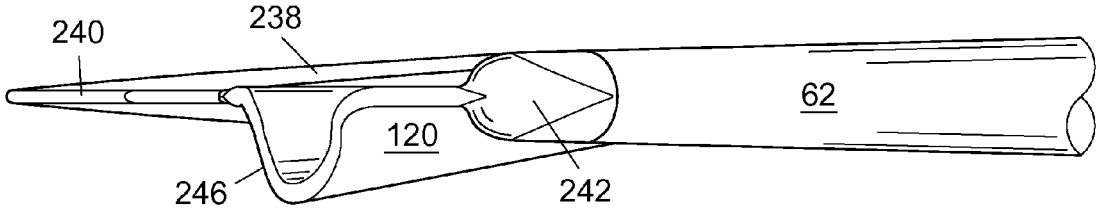
FIG. 26B is a profile view of the trailing edge hinge-web assembly of FIG. 26A.

FIG. 26B is a profile view of the trailing edge hinge-web assembly 268 showing one configuration of tapered end portion 242 and how it can blend into the convex curved trailing edge 246 of the pliable web 120 of FIG. 26A. It further illustrates how the trailing edge 246 of the planar curved vane 238 can become the first point of contact when the user causes the trailing edge 246 to come in contact with objects such at the bottom of the water body or ground.

Figure 26C:
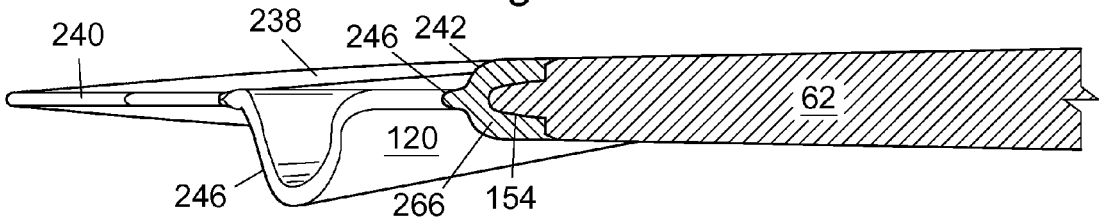
FIG. 26C is a longitudinal cross sectional view through support beam at the tapered end portion of FIG. 26A along arrows 26C.

FIG. 26C is a partial longitudinal cross-sectional view through support beam 62 at the tapered end portion 242 along arrows 26C in FIG. 26A. The extension of the connection bump 154 can support the tapered end portion 242 which can be made of the same pliable material 266 as the pliable web 120. At this location the tapered end portion 242 tapers into trailing edge 246.

Figure 26D:
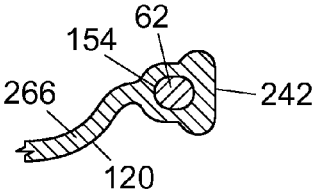
FIG. 26D is a partial lateral cross sectional view through support beam near the end of the connection bump of FIG. 26A along arrows 26D.

FIG. 26D is a partial lateral cross-section view through support beam 62 near the end of the connection bump 154 along arrows 26D in FIG. 26A. At this section the only portion of support beam 62 is the connection bump 154 which can be completely surrounded with pliable material 266 which can make up the tapered end portion 242 and pliable web 120.

Figure 26E:
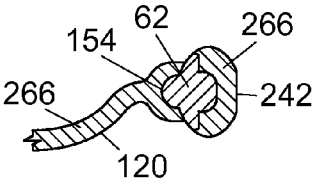
FIG. 26E is a partial lateral cross sectional view through support beam near the end of support beam of FIG. 26A along arrows 26E.

FIG. 26E is a partial lateral cross-sectional view through support beam 62 near the end of support beam 62 along arrows 26E in FIG. 26A. At this section support beam 62 has been tapered to a smaller area and has the connection bump 154 on both lateral sides of it. The pliable material 266 which can make up the tapered end portion 242 and pliable web 120 is shown as two separate areas. All of this can be formed through the common injection molding process called overmolding.

Sixth Embodiment

Figure 27A:
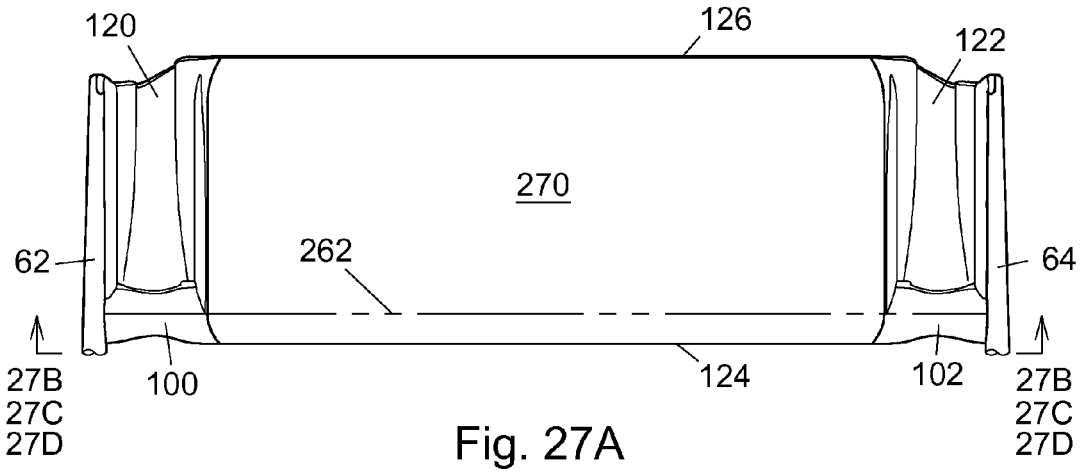
FIG. 27A is a plan view of rearmost portion of the propulsion assembly.
Figure 27B:
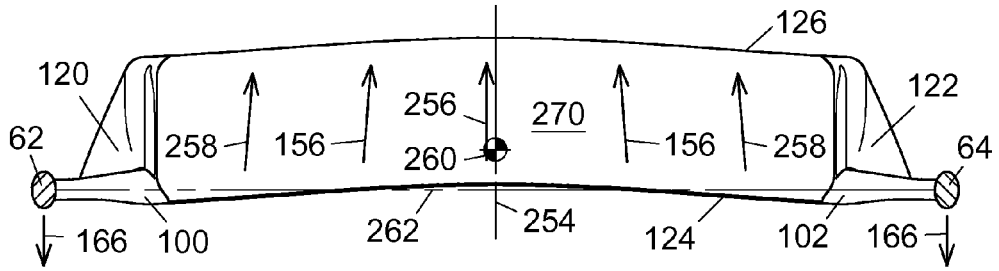
FIG. 27B is a front view of a downstroke cycle using a longitudinally semi-flexible vane in FIG. 27A along arrows 27B.
Figure 27C:
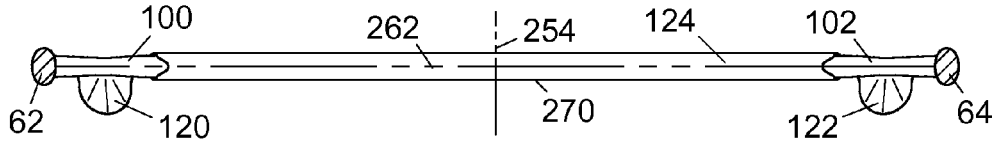
FIG. 27C is a front view of a neutral position using a longitudinally semi-flexible vane in FIG. 27A along arrows 27C.
Figure 27D:
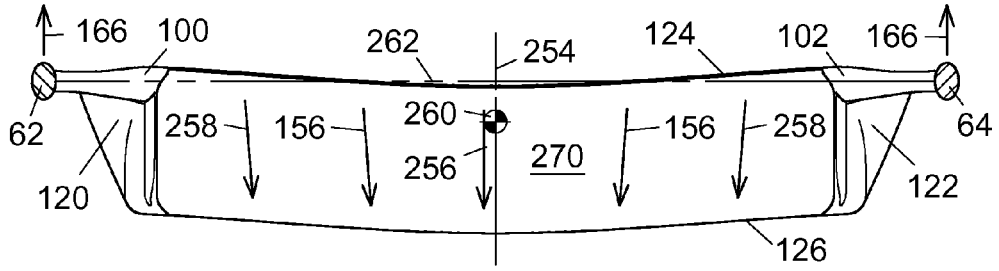
FIG. 27D is a front view of an upstroke cycle using a longitudinally semi-flexible vane in FIG. 27A along arrows 27D.

FIG. 27A is a plan view of the rearmost portion of the propulsion assembly 250 noted in FIG. 22 for a point of reference for FIGS. 27B-27D. This is similar to the first embodiment in the vane arrangement but uses the pliable hinge and web arrangement of the fifth embodiment. Its structure is as defined in FIG. 1 referenced above FIG. 27B is a front view of a downstroke cycle using a longitudinally semi-flexible vane 270 along arrows 27B in FIG. 27A. The direction of foot motion 166 is downward which causes the longitudinally semi-flexible vane 270 to rotate around the axis of rotation 262 to its optimal angle of attack and flex upward as shown by the leading edge 124 curving upward and crossing the axis of rotation 262. The centerline flow 256 remains unchanged and is parallel to the longitudinal axis 254. The outward edge flow 258 direction is changed from diverging from the longitudinal axis 254 to parallel or convergent to the longitudinal axis 254.

Other flow 156 over the longitudinally semi-flexible vane 270 is between the centerline flow 256 and the outward edge flow 258. Bending of the longitudinally semi-flexible vane 270 moves the center of lift 260 away from the axis of rotation 262 and in the opposite direction of the direction of foot motion 166 causing an improvement in stability of the overall reduction of outward spanwise flow causes a reduction in tip vortices and thus parasitic drag resulting in an overall improvement in the lift to drag ratio.

FIG. 27C is a front view of a neutral position using a longitudinally semi-flexible vane 270 along arrow 27C in FIG. 27A. When the swim fin is not being stroked in either direction such as when coasting or not swimming the longitudinally flexible vane 270 is not flexed in either direction and remains aligned with the axis of rotation 262. No flow 156 lines are shown here since they would be directly into the page. There is no resultant lift under this condition.

FIG. 27D is a front view of an upstroke cycle using a longitudinally semi-flexible vane 270 along arrow 27D of FIG. 27A. This is a reverse of the downward stroke described under FIG. 27B above While the invention describes a two step over molding process, the invention can be practiced with a three step process where the foot pocket is molded of a material other than the material used in the vanes, hinges and webs.

Although the embodiments describe the invention for use with swim or sport fins, the invention can use the hydrofoil vanes in other water applications, such as but not limited to boats, paddles, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A fin apparatus for increasing the efficiency of a swimmer or diver during self propulsion through water, comprising:

a plurality of high aspect ratio dynamic vanes arranged in a ladder configuration, each vane having a left end and a right end;

two side beams, each arranged to both side ends of the ladder configuration of vanes;

a foot pocket attached to one end of the side beams;

a plurality of pliable hinges that attach the ends of the vanes to the side beams, the pliable hinges allowing the vanes to rotate on a lateral axis during a kick stroke and be resisted by the pliable hinges, wherein each of the pliable hinges includes:

a flexible hinge mechanism which allows resisted rotation along a central axis of at least two objects wherein each object has a generally conical rigid protrusion fixedly attached and aligned with the other object's generally conical rigid protrusion and separated by a gap;

a centerline of the generally conical rigid protrusions defines generally a centerline of the axis of rotation of the flexible hinge mechanism without using a hinge pin or shaft; and a pliable material overlaid over the generally conical rigid protrusions and gap which allows limited resisted rotation around the axis of rotation for each object, and wherein the axes of rotation of both objects need not be parallel or concentric.

2. The fin apparatus of claim 1, wherein each of the vanes are planarly curved so that a leading edge of the central portion of the vane is behind a leading edge at the lateral edges of the vane.

3. The fin apparatus of claim 1, wherein each of the vanes are longitudinally semi-flexible.

4. The fin apparatus of claim 1, wherein each of the vanes is a flexible vane that flexes in a lateral axis direction.

5. The fin apparatus of claim 1, wherein the side support beams terminate prior to the trailing edge of the trailing vane.

6. The fin apparatus of claim 1, wherein the planar projection of the trailing edge of the pliable webs form a convex curve in relation to the web.

7. The fin apparatus of claim 1, wherein the two side beams, each arranged to both side ends of the ladder configuration of vanes are rotationally fixed to the foot pocket allowing the side beams to flip up relative to the foot pocket.

8. The fin apparatus of claim 7, wherein each of the vanes are planarly curved so that a leading edge of the central portion of the vane is behind a leading edge at the lateral edges of the vane.

9. The fin apparatus of claim 7, wherein each of the vanes are longitudinally semi-flexible.

10. The fin apparatus of claim 7, wherein each of the vanes is a flexible vane that flexes in a lateral axis direction.

11. The fin apparatus of claim 7, wherein the side support beams terminate prior to the trailing edge of the trailing vane.

12. The fin apparatus of claim 7, wherein the planar projection of the trailing edge of the pliable webs form a convex curve in relation to the web.

13. A method of improving the efficiency of a swimmer or diver in self propulsion through water, comprising the steps of:

providing a plurality of dynamic vanes arranged in a ladder configuration, each vane having a left end and a right end;

providing side beams, each arranged on side ends of the ladder configuration of vanes;

providing a plurality of pliable hinges that attach the ends of the vanes to the side beams, the pliable hinges allowing the vanes to rotate on a lateral axis during a kick stroke and be resisted by the pliable hinges, wherein each of the pliable hinges includes:

providing a flexible hinge mechanism in each pliable hinge which allows resisted rotation along a central axis of at least two objects wherein each object has a generally conical rigid protrusion fixedly attached and aligned with the other object's generally conical rigid protrusion and separated by a gap;

providing a centerline of the generally conical rigid protrusions to define a generally a centerline of the axis of rotation of the flexible hinge mechanism without using a hinge pin or shaft; and providing a pliable material overlaid over the generally conical rigid protrusions and gap which allows limited resisted rotation around the axis of rotation for each object, so that axes of rotation of both objects need not be parallel or concentric.

14. The method of claim 13, wherein each of the vanes are planarly curved so that a leading edge of the central portion of the vane is behind a leading edge at the lateral edges of the vane.

15. The method of claim 13, wherein each of the vanes are longitudinally semi-flexible.

16. The method of claim 13, wherein each of the vanes is a flexible vane that flexes in a lateral axis direction.

17. The method of claim 13, wherein the side support beams terminate prior to the trailing edge of the trailing vane.

18. The method of claim 13, wherein the planar projection of the trailing edge of the pliable webs form a convex curve in relation to the web.

19. The method claim 13, wherein the two side beams, each arranged to both side ends of the ladder configuration of vanes are rotationally fixed to the foot pocket allowing the side beams to flip up relative to the foot pocket.

20. The method of claim 19, wherein each of the vanes are planarly curved so that a leading edge of the central portion of the vane is behind a leading edge at the lateral edges of the vane.

21. The method of claim 19, wherein each of the vanes are longitudinally semi-flexible.

22. The method of claim 19, wherein each of the vanes is a flexible vane that flexes in a lateral axis direction.

23. The method of claim 19, wherein the side support beams terminate prior to the trailing edge of the trailing vane.

24. The method of claim 19, wherein the planar projection of the trailing edge of the pliable webs form a convex curve in relation to the web.

* * * * *